US006138566A

United States Patent [19]

Sakamoto

[11] Patent Number: 6,138,566

[45] Date of Patent: Oct. 31, 2000

[54] METHOD AND APPARATUS FOR DEVELOPING PRINTING PLATES IN PRESS

[75] Inventor: Tatsuya Sakamoto, Kyoto, Japan

[73] Assignee: Dainippon Screen Meg Co., LTD, Kyoto, Japan

[21] Appl. No.: 09/156,690

[22] Filed: Sep. 18, 1998

[30] Foreign Application Priority Data

Sep. 30, 1997 [JP] Japan ..... 9-284487

[51] Int. Cl.[7] ..... B41C 1/10

[52] U.S. Cl. ..... 101/463.1; 101/142; 101/401.1

[58] Field of Search ..... 101/135–145, 101/216, 401.1, 463.1, 465–467, 477; 430/302, 309, 310; 355/27, 85, 106

[56] References Cited

U.S. PATENT DOCUMENTS

| | | | |
|---|---|---|---|
| 3,846,816 | 11/1974 | Gaisser | 101/463.1 |
| 4,057,459 | 11/1977 | Mitterhummer et al. | 156/630 |
| 5,055,870 | 10/1991 | Ohba et al. | 101/463.1 |
| 5,094,933 | 3/1992 | Uhrig | 101/467 |
| 5,217,848 | 6/1993 | Uehara et al. | 101/463.1 |
| 5,368,964 | 11/1994 | Adachi et al. | 430/309 |
| 5,438,384 | 8/1995 | Earle | 354/329 |
| 5,469,787 | 11/1995 | Turner et al. | 101/211 |
| 5,734,944 | 3/1998 | Seeley et al. | 430/399 |
| 5,842,414 | 12/1998 | Yoshida et al. | 101/136 |
| 6,009,807 | 1/2000 | Yoshida et al. | 101/177 |

FOREIGN PATENT DOCUMENTS

| | | |
|---|---|---|
| 2130063 | 2/1995 | Canada . |
| 0 512 549 | 11/1992 | European Pat. Off. . |
| 0 771 646 | 5/1997 | European Pat. Off. . |
| 9-123402 | 5/1997 | Japan . |
| 9-131855 | 5/1997 | Japan . |
| 9-141821 | 6/1997 | Japan . |

*Primary Examiner*—Stephen R. Funk
*Attorney, Agent, or Firm*—Arent Fox Kintner Plotkin & Kahn, PLLC

[57] ABSTRACT

A printing apparatus for making a plate by recording and developing images thereon, and thereafter printing the images by feeding inks to the plate. The printing apparatus includes a cylinder for supporting the plate mounted peripherally thereof, a cylinder rotating mechanism for rotating the cylinder, an image recorder for recording the images on the plate mounted on the cylinder, and a developing device for developing the plate mounted on the cylinder. The developing device includes a developing roller reciprocable between an applying position for contacting the plate to apply a developer to the plate mounted peripherally of the cylinder, and a retracted position spaced from the applying position, and a squeeze roller reciprocable between a squeezing position for contacting the plate to squeeze the developer applied by the developing roller off the plate mounted peripherally of the cylinder, and a retracted position spaced from the squeezing position. With this printing apparatus, the image recorder records the images on the plate rotating as mounted on the cylinder, and then the developing roller is placed in contact with the plate rotating as mounted on the cylinder to apply the developer thereto. Subsequently, the squeeze roller is placed in contact with the plate rotating as mounted on the cylinder to remove the developer therefrom.

14 Claims, 28 Drawing Sheets

METHOD AND APPARATUS FOR DEVELOPING PRINTING PLATES IN PRESS

BACKGROUND OF THE INVENTION

1. Field of the Invention

The present invention relates to a printing apparatus for making plates by recording and developing images on the plates, and thereafter printing the images by feeding ink to the plates. The invention relates also to a method of developing plates for use in the printing apparatus.

2. Description of the Related Art

In an ordinary conventional printing apparatus, a prepress process is carried out first to make a plate by exposing the plate placed in contact with a film having a binarized black and white image recorded thereon. Then, the plate is loaded into the printing apparatus to carry out a printing process.

Recently, printing apparatus commonly called digital printers have been proposed, one such printer being capable of performing both the prepress process and printing process. The digital printers employ a "computer-to-plate" system for forming images on plates by directly scanning and exposing the plates with laser beams or the like modulated with image signals.

Such printing apparatus are described in Japanese Patent Publication (Unexamined) H9-141821 (1997), Patent Publication (Unexamined) H9-123402 (1997) and Patent Publication (Unexamined) H9-131855 (1997), for example. Each of the printing apparatus described in these publications has an image recorder for recording images on a plate mounted peripherally of a cylinder such as a plate cylinder, an impression cylinder or a plate-making cylinder. In parallel with the image recording process, a developing process is carried out by placing a developing roller with the plate for applying a developer to the plate.

Since such conventional printing apparatus perform the image recording and developing processes concurrently, the turning angle velocity of the cylinder is dependent on the processing speed of the image recorder. The developing time from application of the developer to the plate to removal of the developer therefrom is determined by the processing speed of image recorder.

Consequently, the plate developing time does not agree with the time required for the developer to develop the plate. This could result in a failure to develop the plate properly, i.e. an overdevelopment or underdevelopment of the plate.

SUMMARY OF THE INVENTION

An object of the present invention, therefore, is to provide a printing apparatus, and a method of developing a plate for use in the printing apparatus, for properly developing the plate mounted peripherally of a cylinder.

The above object is fulfilled, according to the present invention, by a printing apparatus for making a plate by recording and developing images thereon, and thereafter printing the images by feeding inks to the plate, the printing apparatus comprising:

- a cylinder for supporting the plate mounted peripherally thereof;
- a cylinder rotating mechanism for rotating the cylinder;
- an image recorder for recording the images on the plate mounted on the cylinder; and
- a developing device for developing the plate mounted on the cylinder, the developing device including;
  - a developing roller reciprocable between an applying position for contacting the plate to apply a developer to the plate mounted peripherally of the cylinder, and a retracted position spaced from the applying position; and
  - a squeeze roller reciprocable between a squeezing position for contacting the plate to squeeze the developer applied by the developing roller off the plate mounted peripherally of the cylinder, and a retracted position spaced from the squeezing position.

In a preferred embodiment of the invention, the cylinder rotating mechanism is operable for rotating the cylinder such that a period of time from the developing roller contacting the plate mounted on the cylinder to apply the developer thereto to the squeeze roller contacting the plate substantially corresponds to a period of time required for developing the plate with the developer.

Preferably, the cylinder rotating mechanism is operable for rotating the cylinder at a turning angle velocity $\theta/T$ after the developing roller contacts the plate to apply the developer thereto, where $\theta$ is an angle through which the cylinder rotates to move a position of the plate contacted by the developing roller into contact with the squeeze roller, and T is the period of time required for developing the plate with the developer.

With this printing apparatus, the plate developing time is in agreement with the time required for developing the plate with the developer. Consequently, the plate may be developed properly.

In a preferred embodiment of the invention, the developing device further includes a developing roller rotating mechanism for rotating the developing roller in a direction in which the cylinder is rotated by the cylinder rotating mechanism, while the developing roller is maintained in contact with the plate mounted peripherally of the cylinder.

In another preferred embodiment, the developing device further includes a fixing roller reciprocable between an applying position for contacting the plate to apply a fixer to the plate mounted peripherally of the cylinder, and a retracted position spaced from the applying position, the squeeze roller being operable for squeezing also the fixer applied by the fixing roller off the plate.

Preferably, the squeeze roller is disposed between the developing roller and the fixing roller.

In a further preferred embodiment, the printing apparatus comprises a developing device moving mechanism for moving the developing device between a developing position opposed to the cylinder, and a retracted position spaced from the developing position.

In a still further preferred embodiment, the developing device further includes a cleaning mechanism for cleaning the squeeze roller.

In yet another preferred embodiment, the developing device further includes a developer feeding mechanism for feeding the developer only in time of a developing process.

In another aspect of the present invention, a printing apparatus comprises:

- a cylinder for supporting a plate mounted peripherally thereof;
- a cylinder rotating mechanism for rotating the cylinder;
- an image recorder for recording images on the plate mounted on the cylinder;
- a cylinder moving mechanism for moving the cylinder between an image recording position opposed to the image recorder and a printing position for printing with the plate mounted on the cylinder; and
- a developing device operable in the image recording position for developing the plate mounted on the cylinder, the developing device including;

a developing roller reciprocable between an applying position for contacting the plate to apply a developer to the plate mounted peripherally of the cylinder, and a retracted position spaced from the applying position; and a squeeze roller reciprocable between a squeezing position for contacting the plate to squeeze the developer applied by the developing roller off the plate mounted peripherally of the cylinder, and a retracted position spaced from the squeezing position.

In a further aspect of the invention, there is provided a method of developing a plate for use in a printing apparatus which makes the plate by recording and developing images thereon, and thereafter prints the images by feeding inks to the plate. This method comprises:

a step of rotating a cylinder with the plate mounted peripherally thereof, by operating a cylinder rotating mechanism;

an image recording step for recording the plate rotating as mounted on the cylinder, by operating an image recorder;

a developer applying step for applying a developer to the plate rotating as mounted on the cylinder, by placing a developing roller in contact with the plate after the images are recorded on the plate by the image recorder; and a developer removing step for removing the developer from the plate rotating as mounted on the cylinder, by placing a squeeze roller in contact with the plate upon lapse of a time required for developing the plate with the developer after the developer is applied to the plate by the developing roller.

Other features and advantages of the present invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
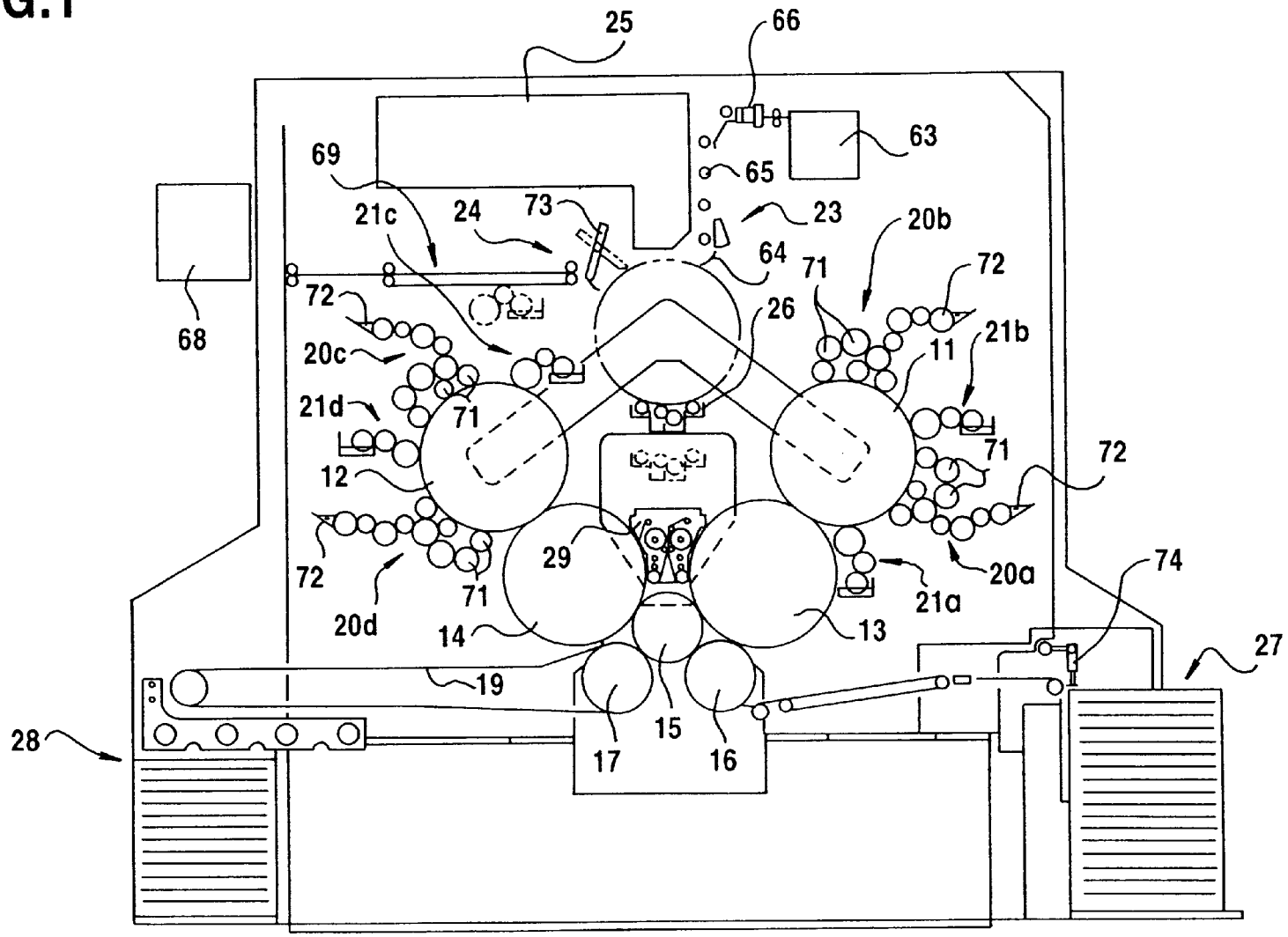
FIG. 1 is a schematic side view of a printing apparatus according to the present invention.

Embodiments of the present invention will be described hereinafter with reference to the drawings. FIG. 1 is a schematic side view of a printing apparatus according to the present invention.

This printing apparatus makes plates by recording and developing images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

According to this printing apparatus, the image recorder 25 and developing device 26 used in a prepress process, and the ink feeders 20 and dampening water feeders 21 used in a printing process may be arranged in separate positions never to interfere with each other, to provide increased freedom for arrangement. Further, images may be recorded on the plates mounted on the first and second plate cylinders 11 and 12 by using the single image recorder 25. This feature contributes toward simplification and low cost of the entire apparatus.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, and a blanket cleaning unit 29.

The first and second plate cylinders 11 and 12 are coupled respectively to first and second plate cylinder moving mechanisms 31 and 32 described hereinafter. Each of the plate cylinders 11 and 12 is driven by the moving mechanism 31 or 32 to reciprocate between the first or second printing position and the image recording position.

As described hereinafter, each of the first and second plate cylinders 11 and 12 has a gear 51 disposed laterally thereof and coaxially therewith. Each of the first and second blanket cylinders 13 and 14 has a gear 52 disposed laterally thereof and coaxially therewith. The gear 51 of the first plate cylinder 11 is meshed with the gear 52 of the first blanket cylinder 13 when the first plate cylinder 11 is in the first printing position. Similarly, the gear 51 of the second plate cylinder 12 is meshed with the gear 52 of the second blanket cylinder 14 when the second plate cylinder 14 is in the second printing position.

Thus, in the first printing position, the first plate cylinder 11 is rotatable synchronously with the first blanket cylinder 13. In the second printing position, the second plate cylinder 12 is rotatable synchronously with the second blanket cylinder 14.

Adjacent the image recording position is a traction type plate cylinder rotating mechanism 30, described hereinafter, for rotating the first or second plate cylinder 11 or 12 whichever is in the image recording position.

Figure 2:
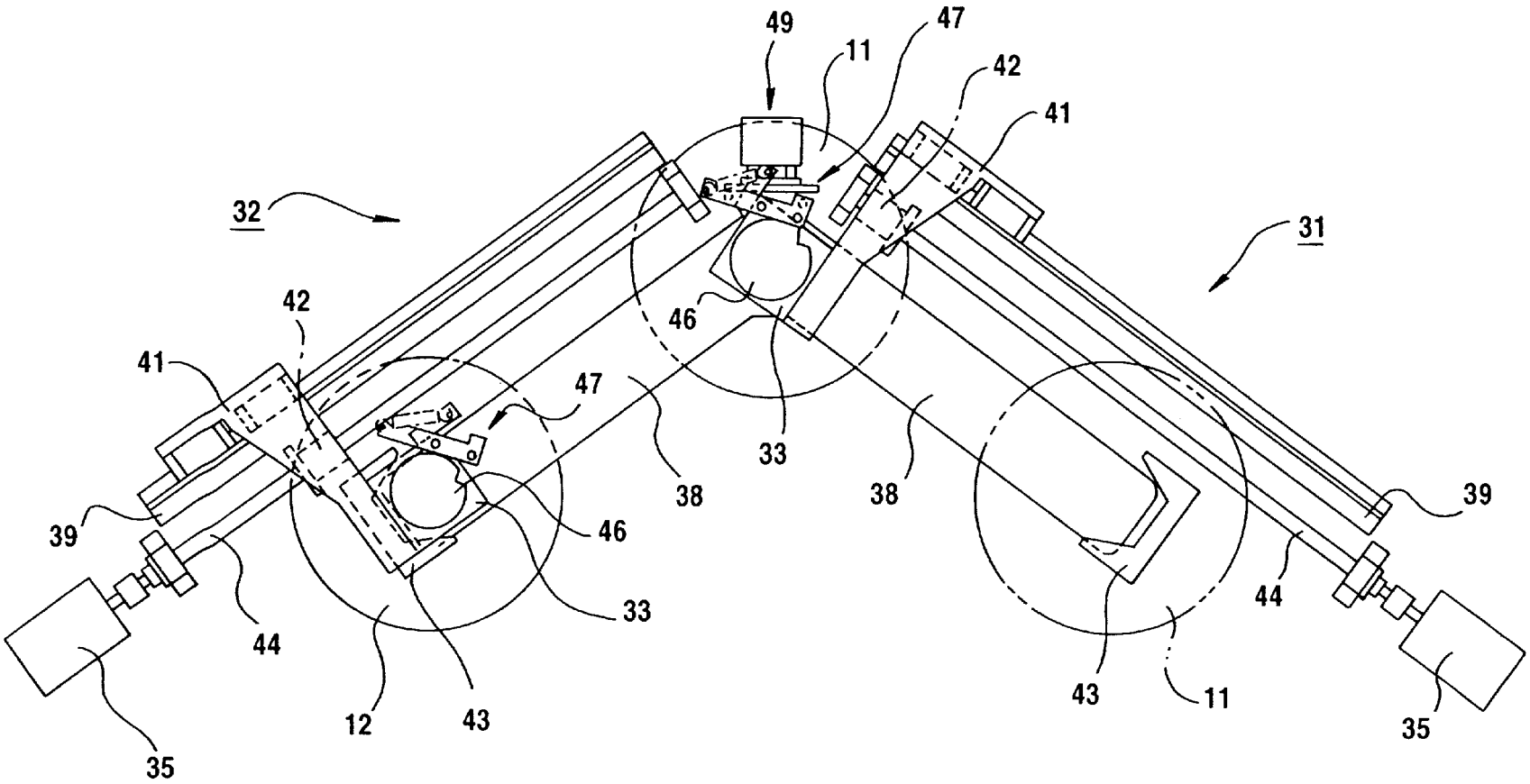
FIG. 2 is a front view of a first and a second plate cylinder moving mechanisms.
Figure 3:
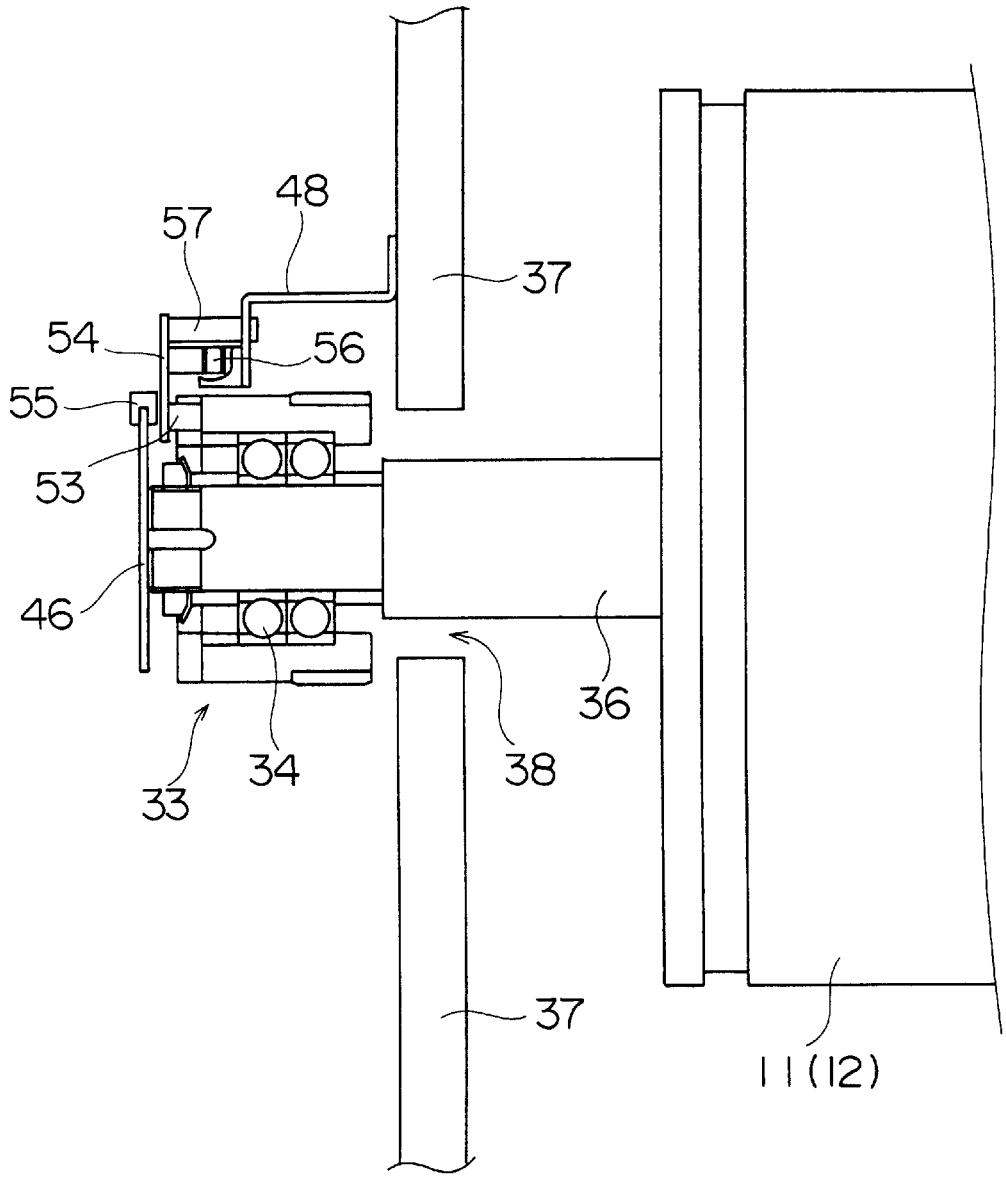
FIG. 3 is a sectional side view showing bearings and adjacent components of the first cylinder moving mechanism.

FIG. 2 is a front view of the first and second plate cylinder moving mechanisms 31 and 32. FIG. 3 is a sectional side view showing bearings and adjacent components of the first cylinder moving mechanism 31. The first and second plate cylinder moving mechanisms 31 and 32 have similar structures symmetrical to each other. Common components of the first and second plate cylinder moving mechanisms 31 and 32 are affixed with the same reference numerals.

Each of the first and second plate cylinder moving mechanisms 31 and 32 has groove slots 38 formed in side plates 37 (FIG. 2 shows only the groove slots 38, and omits the side plates 37), in order to move a bearing assembly 33 including a pair of bearings 34 supporting a shaft 36 of the first or second plate cylinder 11 or 12. The bearing assembly 33 is connected to a slide holder 41 movable along a guide 39. The slide holder 41 includes a nut 42. The nut 42 is meshed with a ball screw 44 coupled to a drive shaft of a motor 35.

Thus, the first plate cylinder 11 is driven by the motor 35 to move with the slide holder 41. The first plate cylinder 11 is movable along the guide 39 and ball screw 44 between the first printing position shown in the solid line in FIG. 1 and in a two-dot chain line in FIG. 2, and the image recording position shown in the two-dot chain line in FIG. 1 and in a solid line in FIG. 2. Similarly, the second plate cylinder 12 is movable along the guide 39 and ball screw 44 between the second printing position shown in solid lines in FIGS. 1 and 2, and the image recording position shown in the two-dot chain line in FIG. 1 and in the solid line in FIG. 2.

A fixing member 43 is attached to the side plate 37 adjacent the first or second printing position for fixing the bearing assembly 33. The first plate cylinder 11 is fixed to the first printing position by the fixing member 43, while the second plate cylinder 12 is fixed to the second printing position by the fixing member 43.

Each of the first and second plate cylinders 11 and 12 has an antirotation mechanism, described hereinafter, for preventing rotation of the plate cylinder 11 or 12 during movement by the first or second plate cylinder moving mechanism 31 or 32.

The first and second plate cylinders 11 and 12 are held against rotation by using the antirotation mechanisms for the following reason; A displacement in a relationship in rotational position between the first or second plate cylinder 11 or 12 and the first or second blanket cylinder 13 or 14 or other components would give rise to a problem of misregistration of printing positions or collision between components. It is therefore necessary to maintain a constant positional relationship between the cylinders 1 and 13 or 12 and 14. When the image recorder 25, described hereinafter, records images on a plate mounted on the first or second plate cylinder 11 or 12, a photocoupler 87, described hereinafter, or a rotary encoder monitors a rotational position of the plate cylinder 11 or 12. However, the first or second plate cylinder 11 or 12 could rotate inadvertently during the movement from the image recording position to the first or second printing position, resulting in a displacement in the relationship in rotational position between the first or second plate cylinder 11 or 12 and the first or second blanket cylinder 13 or 14. To avoid such an inconvenience, the antirotation mechanism is used to prevent rotation of the first or second plate cylinder 11 or 12 during movement.

Each antirotation mechanism includes a rotatable disk 46 connected to the shaft 36 of the first or second plate cylinder 11 or 12 and having a cutout formed peripherally of the disk 46, a detent 47 engageable with the cutout to stop rotation of the rotatable disk 46, a release member 48 disposed adjacent the first or second printing position for disengaging the detent 47 from the cutout formed in the rotatable disk 46, and a release member 49 disposed adjacent the image recording position for disengaging the detent 47 from the cutout formed in the rotatable disk 46.

Figure 4:
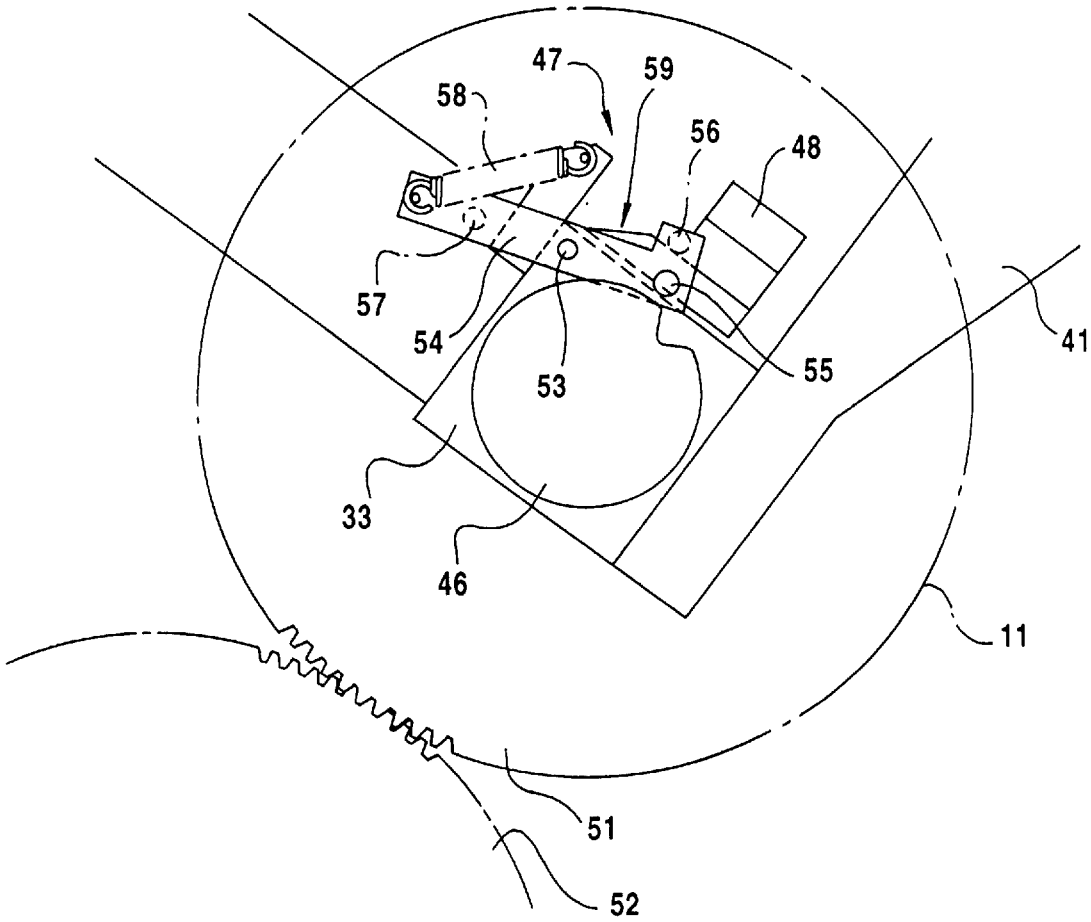
FIG. 4 is a schematic view showing a relationship between a detent attached to a first plate cylinder and a release member disposed in a first printing position.

FIG. 4 is a schematic view showing a relationship between the detent 47 attached to the first plate cylinder 11 and the release member 48 disposed in the first printing position. The detent 47 includes a lever 54 pivotable about an axis 53 attached to the bearing assembly 33, an engaging pin 55 projecting from a front surface of the lever 54, a guide pin 56 projecting from a rear surface of the lever 54 opposite from the engaging pin 55, a press pin 57 opposed to the guide pin 56 across the axis 53, and a spring 58 for biasing the lever 54 in a direction to move the engaging pin 55 toward the rotatable disk 46. The release member 48 is in the form of a cam defining a ramp 59 for guiding the guide pin 56.

The detent 47 of the second plate cylinder 12 has a construction similar to the above, and so does the release member 48 disposed in the second printing position.

Figure 7:
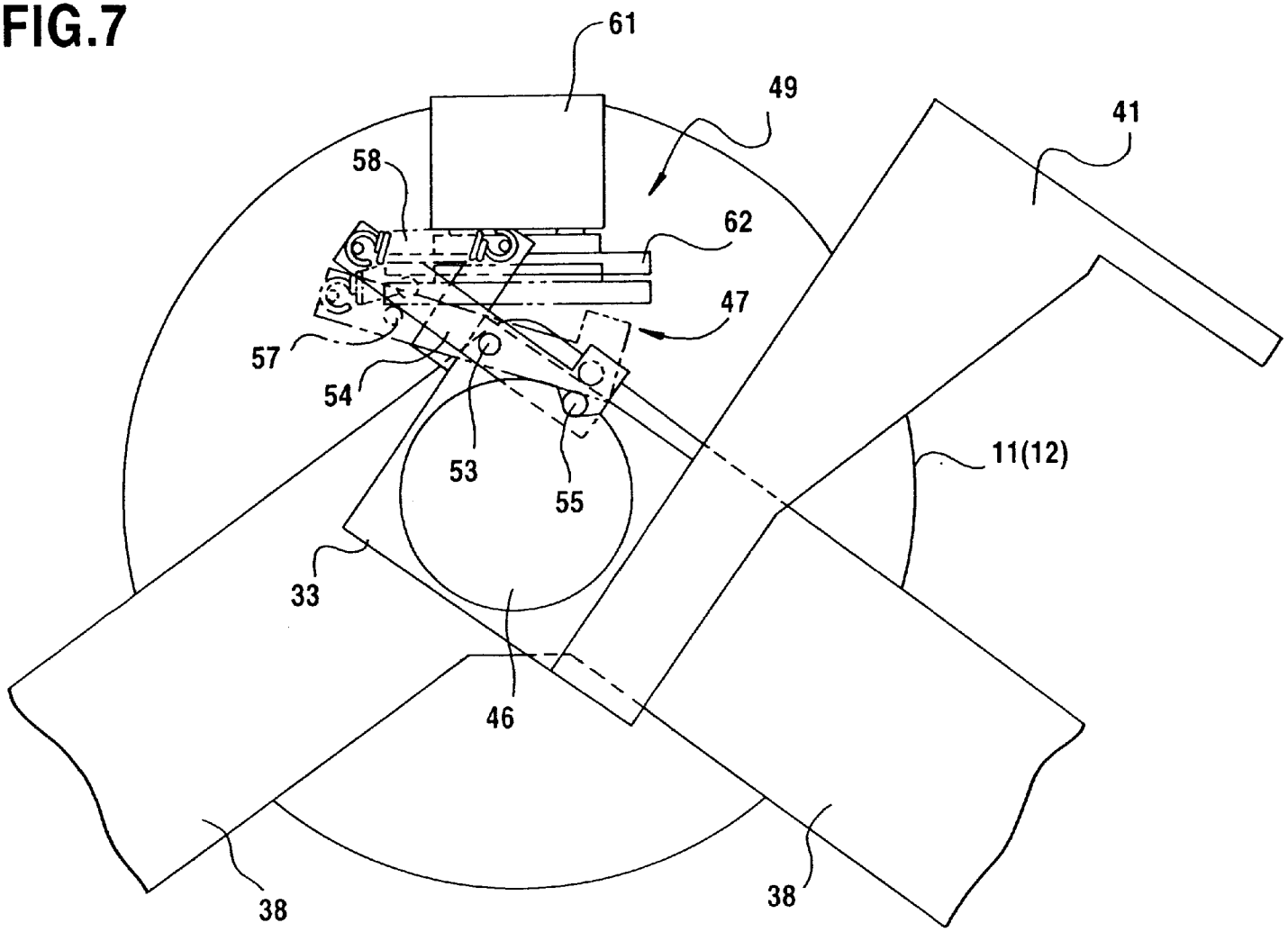
FIG. 7 is a schematic view showing a relationship between the detent attached to the first plate cylinder and a release member disposed in an image recording position.

FIG. 7 is a schematic view showing a relationship between the detent 47 and the release member 49 disposed in the image recording position. The release member 49 includes a presser plate 62 reciprocable by an air cylinder 61 for depressing the press pin 57 of the detent 47 of the first plate cylinder 11 having moved to the image recording position.

When the second plate cylinder 12 is in the image recording position, the press pin 57 of the detent 47 attached to the second plate cylinder 12 is depressed by the presser plate 62 of the release member 49.

Figure 8:
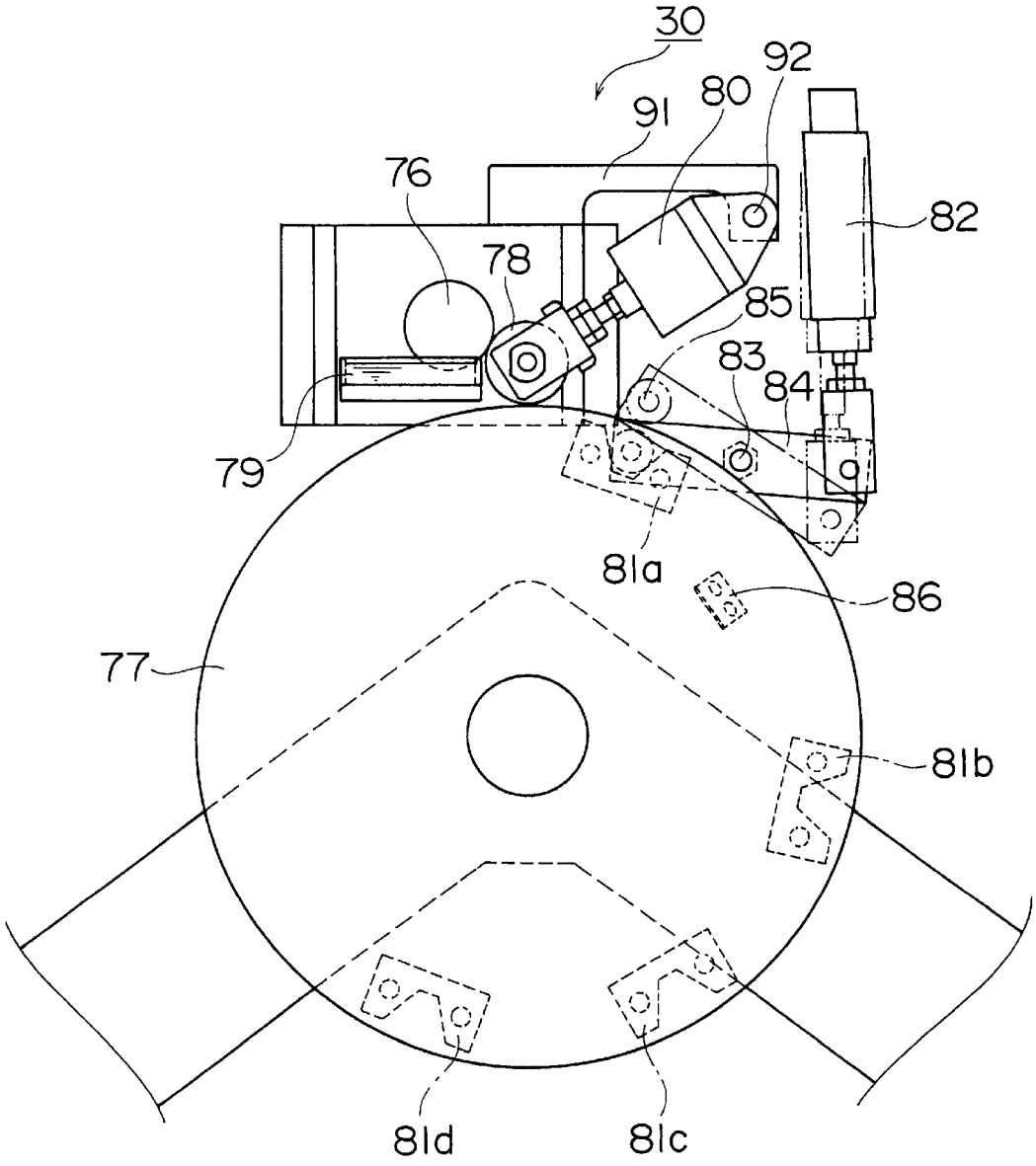
FIG. 8 is a front view of a plate cylinder rotating mechanism and adjacent components.
Figure 9:
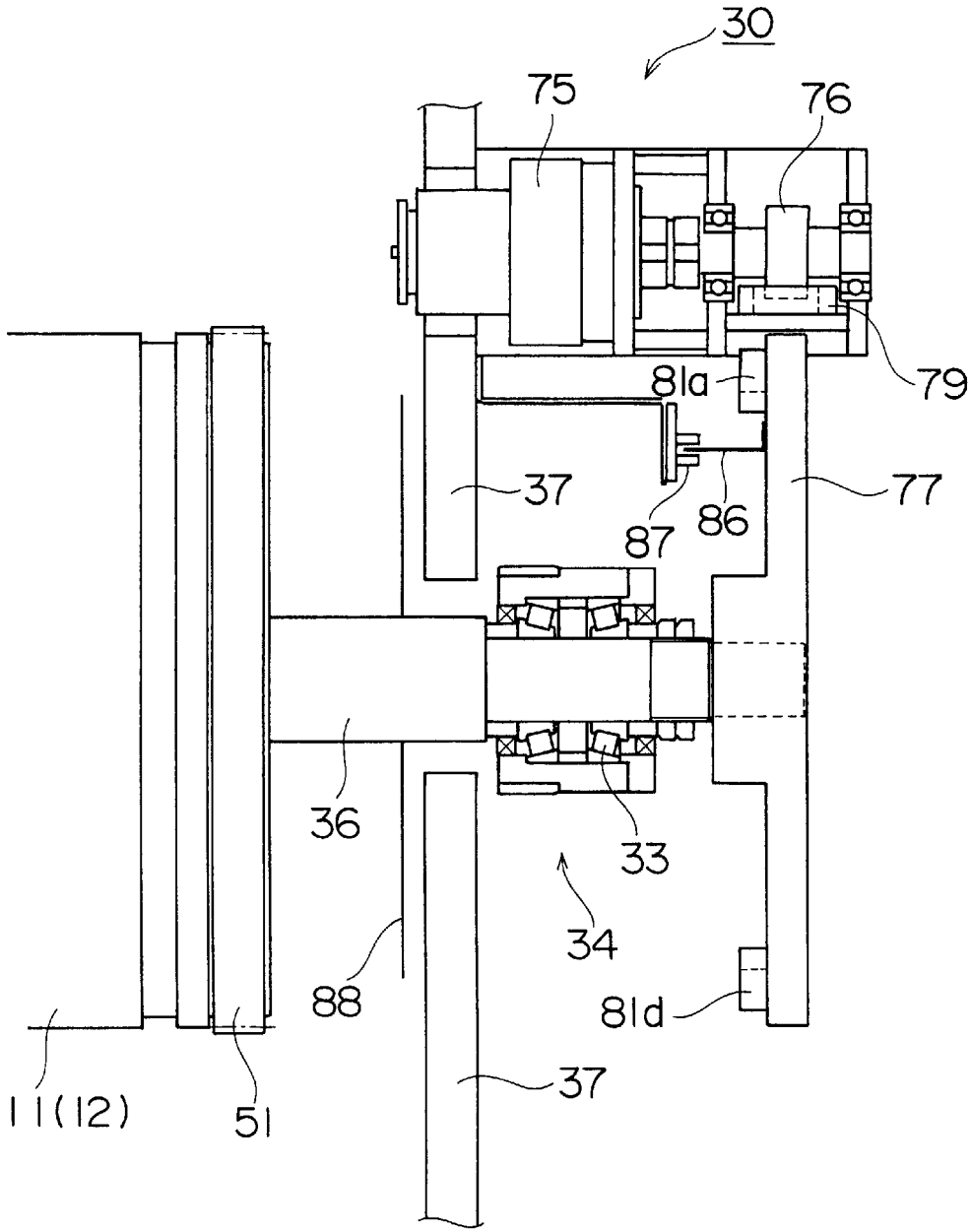
FIG. 9 is a sectional side view showing a principal portion of FIG. 8.

FIG. 8 is a front view of the above plate cylinder rotating mechanism 30 and adjacent components. FIG. 9 is a sectional side view of a principal portion thereof. The plate cylinder rotating mechanism 30 is operable to rotate the first or second plate cylinder 11 or 12 in the image recording position. The plate cylinder rotating mechanism 30 is opposed to the antirotation mechanism across the first or second plate cylinder 11 or 12. It is to be noted that a transmission roller 78 and its moving mechanism are omitted from FIG. 9.

The plate cylinder rotating mechanism 30 includes a drive roller 76 rotatable by a drive motor 75, first and second driven rollers 77 connected to the shafts 36 of the first plate cylinder 11 and second plate cylinder 12 to be coaxial with the plate cylinders 11 and 12, respectively, and the transmission roller 78 for transmitting drive from the drive roller 76 to one of the driven rollers 77 mounted coaxially with the first plate cylinder 11 and second plate cylinder 12.

The drive roller 76 has a lower portion thereof immersed in oil stored in an oil pan 79. As noted above, each driven roller 77 is mounted coaxially with the first or second plate cylinder 11 or 12 through the shaft 36 of the plate cylinder 11 or 12, to be rotatable synchronously therewith. Further, the transmission roller 78 is rotatably supported at the distal end of a cylinder rod of the air cylinder 80 having a proximal end thereof oscillatably coupled to a support member 91 through an axis 92. The transmission roller 78 is movable by the air cylinder 80 between a drive transmitting position in pressure contact with both of the drive roller 76 and driven roller 77 and a retracted position away from the drive roller 76 and driven roller 77.

When, with the transmission roller 78 moved to the drive transmitting position, the drive motor 75 rotates the drive roller 76 at a fixed speed, the rotation of the drive roller 76 is transmitted to the driven roller 77 through the transmission roller 78, whereby the first or second plate cylinder 11 or 12 rotates at a fixed speed. At this time, the drive of the motor 75 is transmitted to the first or second plate cylinder 11 or 12. The traction type drive transmission mechanism utilizing friction among the drive roller 76, driven roller 77 and transmission roller 78. Thus, the first or second plate cylinder 11 or 12 is rotated accurately without any irregularities.

Particularly, in the foregoing embodiment, the transmission roller 78 is movable between the drive transmitting position in pressure contact with both of the drive roller 76 and driven roller 77 and the retracted position away from the drive and driven rollers 76 and 77. After the first or second plate cylinder 11 or 12 is moved to the image recording position, the transmission roller 78 is placed in pressure contact with the drive roller 76 and driven roller 77. Thus, the first or second plate cylinder 11 or 12 is rotated accurately with no slippage among the transmission roller 78, drive roller 76 and driven roller 77.

Consequently, even where, as in the printing apparatus in this embodiment, the driven rollers 77 move in different directions as the first and second plate cylinders 11 and 12 move between the image recording position and the first and second printing positions, the transmission roller 78 may be pressed not only on the drive roller 76 but on one of the driven rollers 77 having moved to the image recording position. This is achieved by moving the transmission roller 78 to the drive transmitting position in pressure contact with both of the drive roller 76 and driven roller 77 after the first or second plate cylinder 11 or 12 has moved to the image recording position. Thus, the first or second plate cylinder 11 or 12 is rotated accurately with no slippage among the transmission roller 78, drive roller 76 and driven roller 77.

Each driven roller 77 has four positioning members 81*a*, 81*b*, 81*c* and 81*d* in the form of V-blocks for positioning and fixing the first or second plate cylinder 11 or 12 to a predetermined angular position. The positioning members 81*a*, 81*b*, 81*c* and 81*d* are engageable with an engaging pin 85 disposed at a distal end of a lever 84 pivotable about an axis 83 by an air cylinder 82. In this way, the positioning members 81*a*, 81*b*, 81*c* and 81*d* are used to position and fix the first or second plate cylinder 11 or 12 to a predetermined angular position.

Each driven roller 77 further includes a detection plate 86 erected thereon for use in detecting an angular position of the driven roller 77. Each side plate 37 has a photocoupler 87 for detecting the detection plate 86. The angular position of the driven roller 77, i.e. that of the first or second plate cylinder 11 or 12, is monitored based on a detection signal of the photocoupler 87 detecting the detection plate 86, and a pulse signal generated, in response to rotation of the first or second plate cylinder 11 or 12, by a rotary encoder, not shown, connected to the shaft 36 of the first or second plate cylinder 11 or 12.

Further, a light-shielding plate 88 is mounted on the shaft 36 of each of the first and second plate cylinders 11 and 12.

An operation of the above antirotation mechanism for preventing rotation of the first or second plate cylinder 11 or 12, and an operation of the traction type plate cylinder rotating mechanism 30 for rotating the first or second plate cylinder 11 or 12, will be described next. In the following description, a rotation preventing operation and a rotating operation are effected for the first plate cylinder 11. It will be appreciated that similar steps are taken in a rotation preventing operation and a rotating operation for the second plate cylinder 12.

When the first plate cylinder 11 is in the first printing position as shown in FIG. 4, the gear 51 disposed coaxially with the first plate cylinder 11 is engaged with the gear 52 disposed coaxially with the first blanket cylinder 13.

Figure 5:
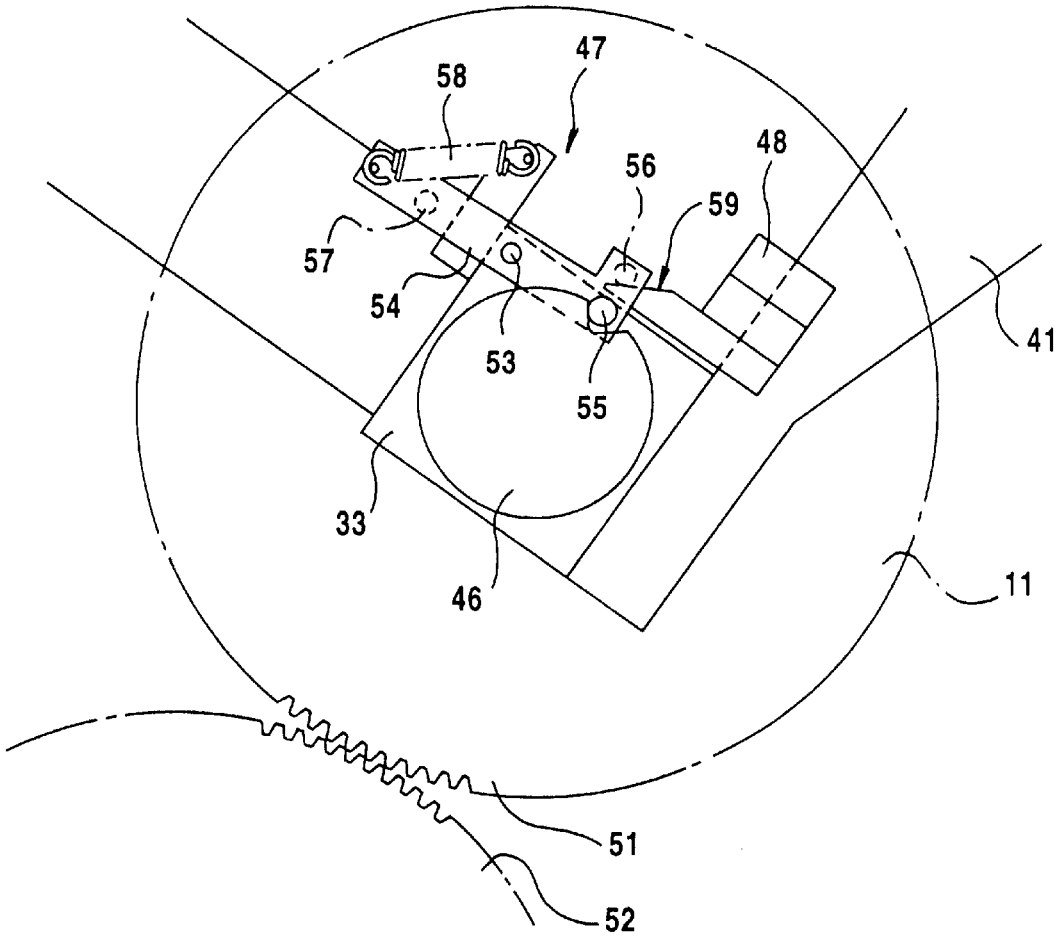
FIG. 5 is another schematic view showing the relationship between the detent and release member.

When the first plate cylinder moving mechanism 31 starts moving the first plate cylinder 11 from the first printing position to the image recording position as shown in FIG. 5, the gear 51 disposed coaxially with the first plate cylinder 11 gradually moves out of engagement with the gear 52 disposed coaxially with the first blanket cylinder 13. At this time, the guide pin 56 of the detent 47 slides along the ramp 59 of the release member 48, causing the lever 54 to pivot about the axis 53. As a result, the engaging pin 55 starts moving into the cutout of the rotatable disk 46.

At this time, the gear 51 disposed coaxially with the first plate cylinder 11 is not completely out of engagement with the gear 52 disposed coaxially with the first blanket cylinder 13. The rotation of the first plate cylinder 11 is not yet prevented by the detent 47. Thus, in the state shown in FIG. 5, the first plate cylinder 11 moves toward the image recording position while rotating counterclockwise. Consequently, the gears 51 and 52 are prevented from damage due to a collision with each other.

Figure 6:
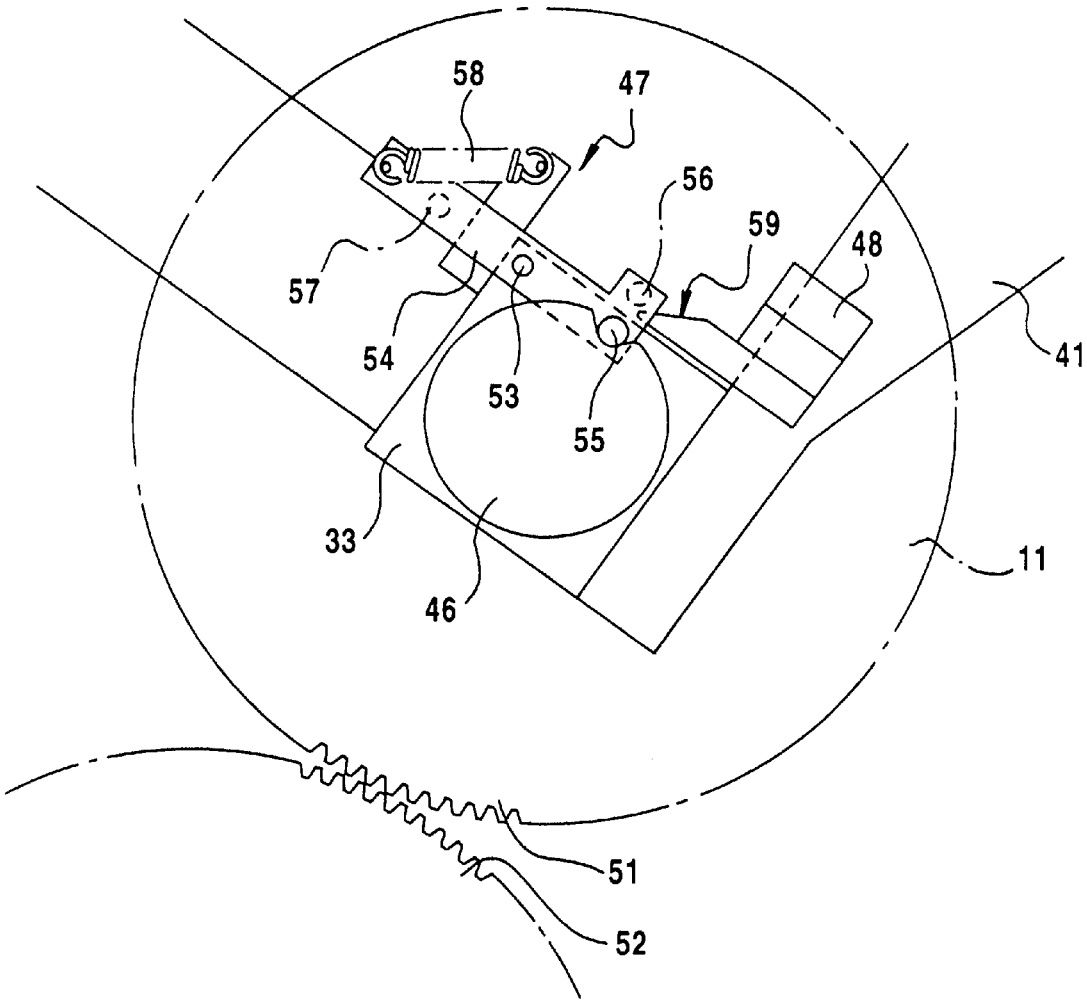
FIG. 6 is yet another schematic view showing the relationship between the detent and release member.

As the first plate cylinder 11 moves further toward the image recording position, the gear 51 disposed coaxially with the first plate cylinder 11 becomes disengaged from the gear 52 disposed coaxially with the first blanket cylinder 13 as shown in FIG. 6. In this state, the guide pin 56 of the detent 47 is completely disengaged from the ramp 59 of the release member 48, and the engaging pin 55 is completely fitted in the cutout of the rotatable disk 46. Consequently, the first plate cylinder 11 is locked against rotation.

In this state, the first plate cylinder moving mechanism 31 moves the first plate cylinder 11 to the image recording position as shown in FIG. 7. Then, as shown in FIG. 8, the air cylinder 80 moves the transmission roller 78 of the plate cylinder rotating mechanism 30 to the drive transmitting position in pressure contact with both of the drive roller 76 and driven roller 77. Subsequently, the air cylinder 61 moves the presser plate 62 of the release member 49 from a position shown in a solid line to a position shown in a two-dot chain line in FIG. 7. As a result, the press pin 57 of the detent 47 is depressed to cause the lever 54 to pivot about the axis 53, thereby moving the engaging pin 55 out of the cutout in the rotatable disk 46. The first plate cylinder 11 has now become rotatable.

In this state, the traction type plate cylinder rotating mechanism 30 rotates the first plate cylinder 11 at low speed. After a plate is placed on the first plate cylinder 11, the image recorder 25 records images on the plate. After the images are recorded on the plate, the images are developed by the developing device 26 to be described in detail hereinafter. During the developing process, the plate cylinder rotating mechanism 30 rotates the first plate cylinder 11 at an angular velocity suited for development of the images on the plate. After the image recording and developing processes for the plate, the first plate cylinder 11 is returned to home position by using detection values provided by the detection plate 86 and photocoupler 87. The air cylinder 80 moves the transmission roller 78 of the plate cylinder rotating mechanism 30 to the retracted position. The air cylinder 82 shown in FIG. 8 is operated to engage the engaging pin 85 with the positioning member 81*a*. As a result, the first plate cylinder 11 is fixed to a predetermined angular position through the driven roller 77.

Subsequently, the air cylinder 61 moves the presser plate 62 of the release member 49 from the position shown in the two-dot chain line to the position shown in the solid line in FIG. 7. Thus, the press pin 57 of the detent 47 moves upward to cause the lever 54 to pivot about the axis 53, thereby moving the engaging pin 55 of the detent 47 into engagement with the cutout in the rotatable disk 46. As a result, the first plate cylinder 11 is locked against rotation.

Then, the first plate cylinder moving mechanism 31 moves the first plate cylinder 11 from the image recording position to the first printing position. With this movement of the first plate cylinder 11, the engaging pin 55 of the detent 47 becomes disengaged from the rotatable disk 46 in an operation reversed from the operation occurring with the movement the first plate cylinder 11 from the first printing position to the image recording position shown in FIGS. 4 through 6.

That is, as the first plate cylinder 11 moves from the position shown in FIG. 6 to the position shown in FIG. 5, the guide pin 56 of the detent 47 slides along the ramp 59 of the release member 48 to cause the lever 54 to pivot about the axis 53. As a result, the engaging pin 55 moves out of the cutout of the rotatable disk 46. At the same time, the gear 51 disposed coaxially with the first plate cylinder 11 begins to engage the gear 52 disposed coaxially with the first blanket cylinder 13.

As the gear 51 disposed coaxially with the first plate cylinder 11 begins to engage the gear 52 disposed coaxially with the first blanket cylinder 13, the detent 47 releases the first plate cylinder 11. Then, the first plate cylinder 11, in the state shown in FIG. 5, moves toward the first printing position while rotating clockwise. Consequently, the gears 51 and 52 are prevented from damage due to a collision with each other.

When the first plate cylinder 11 returns to the first printing position as shown in FIG. 4, the gear 51 disposed coaxially with the first plate cylinder 11 is fully engaged with the gear 52 disposed coaxially with the first blanket cylinder 13.

Referring again to FIG. 1, the plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of grippers, not shown, for gripping the forward and rear ends of the plate fed from the plate feeder 23.

The plate remover 24 has a pawl mechanism 73 for separating a plate from the first or second plate cylinder 11 or 12 after a printing operation, and a conveyor mechanism 69 for transporting the plate separated by the pawl mechanism 73 to a discharge cassette 68.

The forward end of the plate drawn from the feeder cassette 63 is guided by the guide rollers 65 and guide member 64, and gripped by one of the grippers on the first or second plate cylinder 11 or 12. Then, the first or second plate cylinder 11 or 12 is rotated by the plate cylinder rotating mechanism 30, whereby the plate is wrapped around the first or second plate cylinder 11 or 12. The rear end of the plate cut by the cutter 66 is gripped by the other gripper. While, in this state, the first or second plate cylinder 11 or 12 is rotated at low speed by the rotating mechanism 30 as described above, the image recorder 25 irradiates the surface of the plate mounted peripherally of the first or second plate cylinder 11 or 12 with a modulated laser beam for recording images thereon.

Figure 10A:
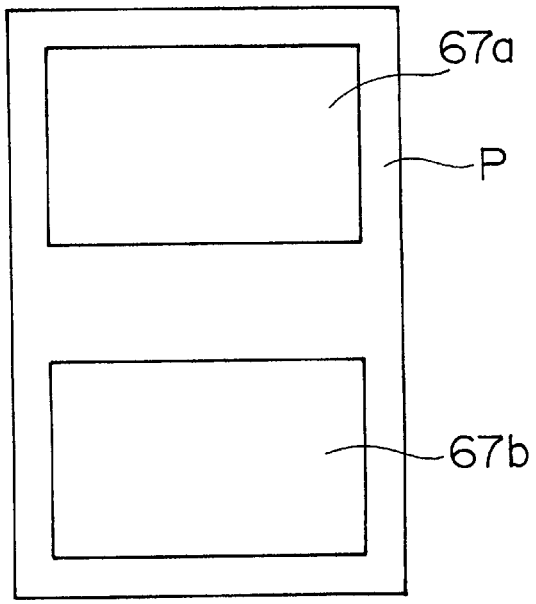
FIGS. 10A and 10B are explanatory views each showing an arrangement of image areas on a plate.
Figure 10B:
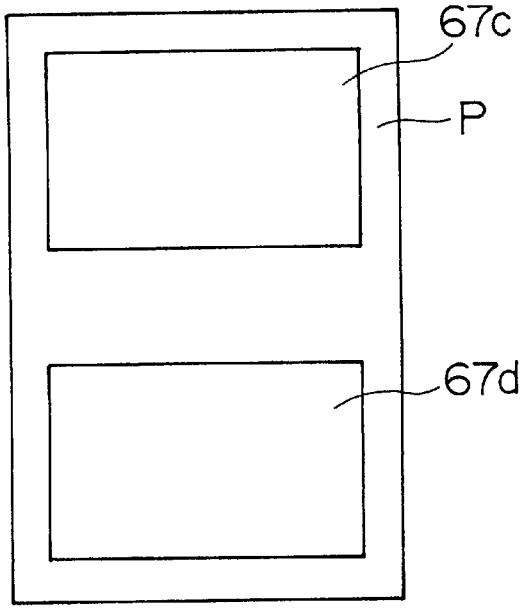

On the plate P mounted peripherally of the first plate cylinder 11, the image recorder 25, as shown in FIG. 10A, records an image area 67*a* to be printed with black ink, and an image area 67*b* to be printed with magenta ink. On the plate P mounted peripherally of the second plate cylinder 12, the image recorder 25, as shown in FIG. 10B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

In the foregoing embodiment, two image areas 67*a* and 67*b* or 67*c* and 67*d* are provided on the single plate P mounted peripherally of the first or second plate cylinder 11 or 12, in order to simplify the structure of the first or second plate cylinder 11 or 12. Alternatively, the first or second plate cylinder 11 or 12 may include two sets of grippers, each set for holding the forward and rear ends of one plate P. Then, each of the first and second plate cylinders 11 and 12 may support two plates P. In this case also, the two plates P should be held as evenly separated on the first or second plate cylinder 11 or 12, so that the image areas recorded on the respective plates are in evenly separated positions, i.e. in positions separated from each other by 180 degrees.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an inkwell 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of these dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

The developing device 26 noted hereinbefore is disposed under the first or second plate cylinder 11 or 12 in the image recording position. This developing device 26 includes a developing unit 371, a fixing unit 372 and a drying unit 373, which are vertically movable between a standby position shown in two-dot chain lines and a developing position shown in solid lines in FIG. 1. The developing device 26 will be described in greater detail hereinafter.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism described hereinafter.

Figure 11:
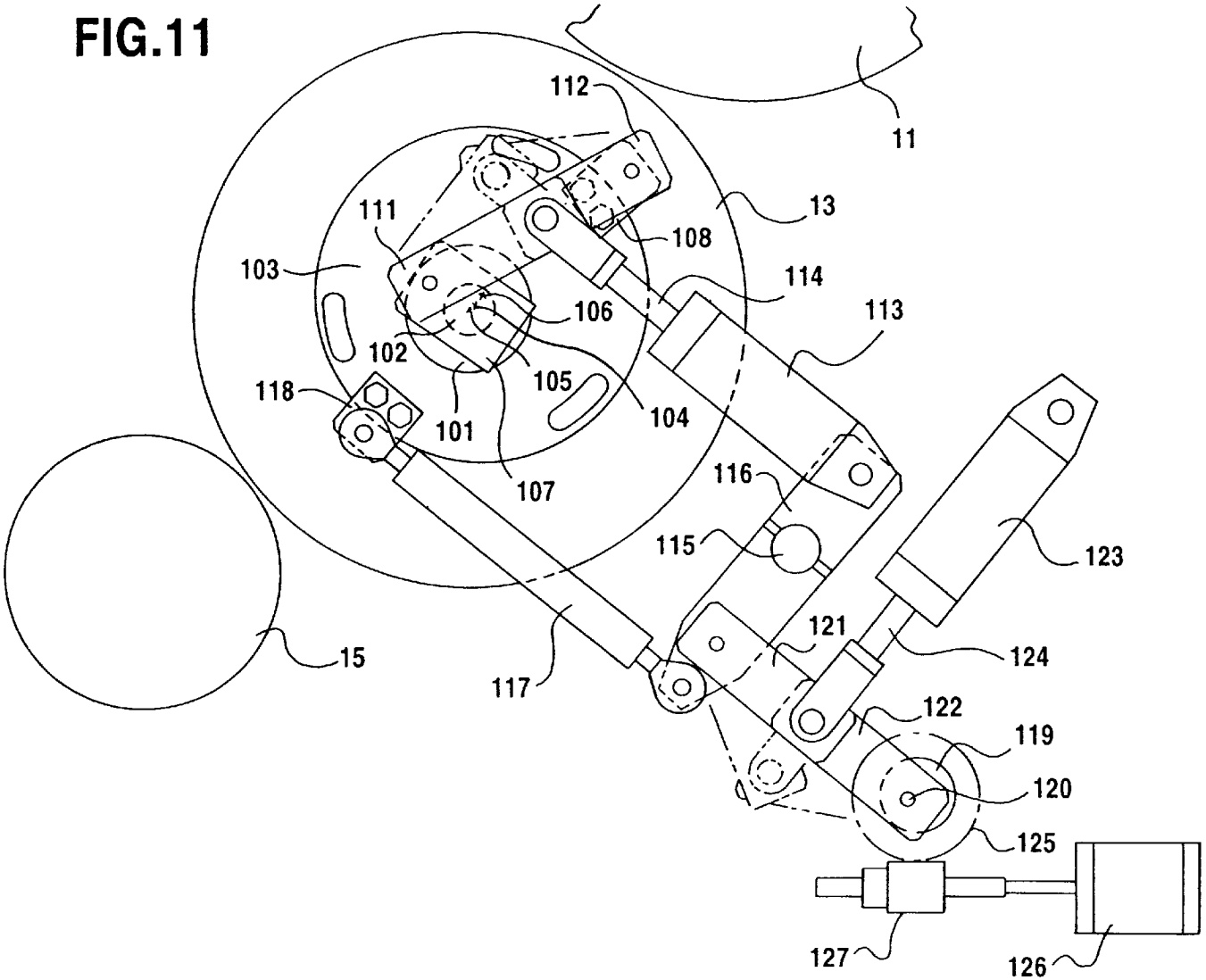
FIG. 11 is a schematic view of a contact mechanism for acting on a first blanket cylinder.

FIG. 11 is a schematic view of the contact mechanism for acting on the first blanket cylinder 13. The contact mechanism for the second blanket cylinder 14 is similar in structure to the contact mechanism shown in FIG. 11.

The first blanket cylinder 13 is rotatably supported by a shaft 101. An eccentric shaft 102 decentered from the shaft 101 is formed on a side thereof. The eccentric shaft 102 is surrounded by an eccentric bearing 103 decentered from the shafts 101 and 102. Thus, as shown in FIG. 11, the axis 104 of the shaft 101, i.e. the axis of the first blanket cylinder 13, the axis 105 of the eccentric shaft 102 and the axis 106 of the eccentric bearing 103 are offset from one another.

The eccentric shaft 102 has a plate 107 fixed thereto, while the eccentric bearing 103 has a plate 108 fixed thereto. The two fixed plates 107 and 108 are interconnected by two coupling plates 111 and 112 forming a link mechanism. The forward end of a cylinder rod 114 of an air cylinder 113 is connected to a connection between the two coupling plates 111 and 112. The air cylinder 113 has a cylinder body coupled to an end of a rotary plate 116 rotatable about a shaft 115. The other end of the rotary plate 116 is coupled through a rod 117 to a plate 118 fixed to the eccentric bearing 103.

The rotary plate 116 is coupled to a shaft 120 of an eccentric member 119 through two coupling plates 121 and 122 forming a link mechanism. The forward end of a cylinder rod 124 of an air cylinder 123 fixed to a main body of the apparatus is connected to a connection between the two coupling plates 121 and 122. The eccentric member 119 has a worm wheel 125 connected thereto and meshed with a worm gear 127 rotatable by a motor 126.

With the cylinder rods 114 and 124 of the air cylinders 113 and 123 extended as shown in FIG. 11, the surface of the first blanket cylinder 13 is spaced slightly from the surfaces of the first plate cylinder 11 and the impression cylinder 15.

When the air cylinder 113 is driven to retract the cylinder rod 114, the first blanket cylinder 13 is moved toward and into contact with the first plate cylinder 11 by action of the link mechanism formed of the two coupling plates 111 and 112.

When the air cylinder 123 is driven to retract the cylinder rod 124, the first blanket cylinder 13 is moved toward and into contact with the impression cylinder 15 by action of the link mechanism formed of the two coupling plates 121 and 122. At this time, the rotary plate 116 also rotates clockwise about the shaft 115, whereby the first blanket cylinder 13 moves not only toward the impression cylinder 15 but also toward the first plate cylinder 11. Consequently, the first blanket cylinder 13 is maintained in contact with the first plate cylinder 11.

Rotation of the eccentric member 119 results in a slight movement of its shaft 120. Thus, the contact pressure of the first blanket cylinder 13 for contacting the impression cylinder 15 and the first plate cylinder 11 may be adjusted by driving the motor 126 to rotate the worm wheel 125 connected to the eccentric member 119, thereby to move the shaft 120 slightly. This enables adjustment of a printing pressure in time of printing with the first blanket cylinder 13.

Referring again to FIG. 1, the blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14. The cleaning cloth may further be brought into contact with the surface of the impression cylinder 15 for cleaning the same.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers arranged thereon, respectively. When the impression cylinder 15 transfers the printing paper to the discharge cylinder 17, one of the grippers of the discharge cylinder 17 holds the forward end of the printing paper having been held by the gripper of the impression cylinder 15. With movement of the chains 19, the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by the gears 51 and 52 mounted on end portions thereof as described hereinbefore. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 12:
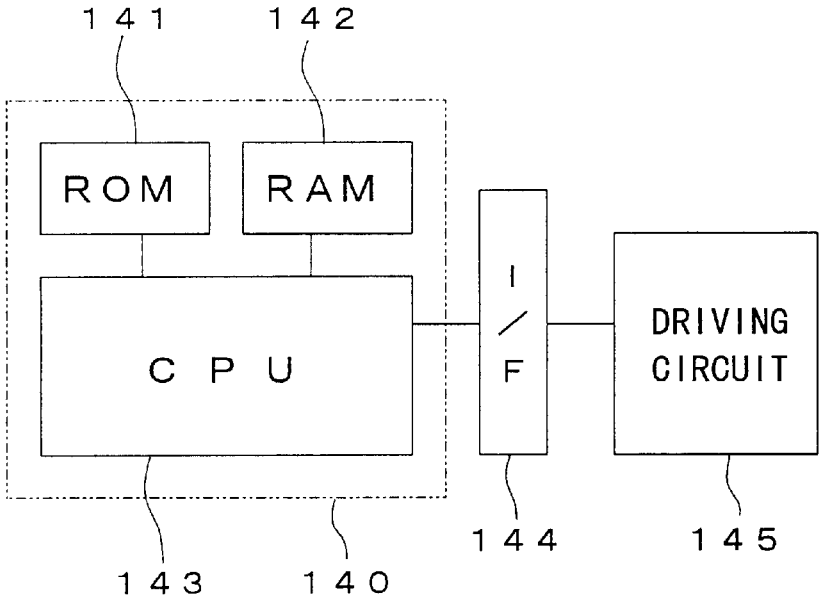
FIG. 12 is a block diagram showing a principal electrical structure of the printing apparatus.

FIG. 12 is a block diagram showing a principal electrical structure of the printing apparatus. This printing apparatus includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, image recorder 25, developing device 26, blanket cleaning unit 29, the moving mechanisms for moving the first and second plate cylinders 11 and 12, the contact mechanisms for the first and second blanket cylinders 13 and 14, and so on. The printing apparatus is controlled by the control unit 140 to execute prepress and printing operations as described hereinafter.

Figure 13:
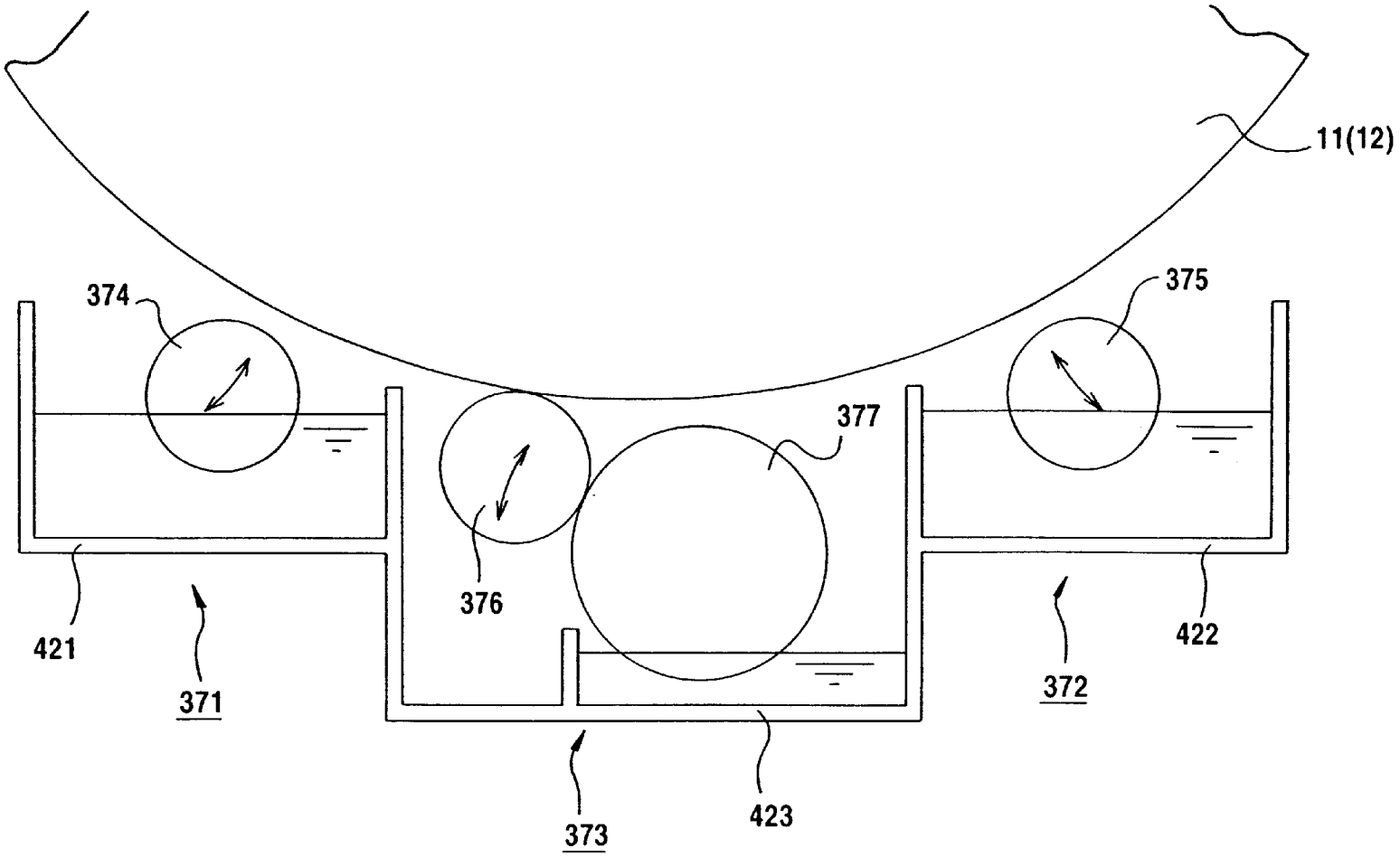
FIG. 13 is a schematic side view of a developing device.

The construction of developing device 26 which characterizes the present invention will be described next. FIG. 13 is a schematic side view of the developing device 26.

The developing device 26 includes a developing unit 371 for applying a developer to and developing the plate P mounted peripherally of the first or second plate cylinder 11 or 12 in the image recording position, a fixing unit 372 for applying a fixer to and fixing the images to the plate P, a squeezing unit 373 for removing the developer and fixer from the plate P. The developing unit 371, fixing unit 372 and squeezing unit 373 are movable by a developing device moving mechanism 378, described hereinafter, between a developing position shown in solid lines and a retracted position shown in phantom lines in FIG. 1. In this specification, a developing process and a fixing process are collectively called the developing process as necessary.

As shown in FIG. 13, the developing unit 371 includes a developer tank 421 for storing the developer, and a developing roller 374 with a lower portion thereof immersed in the developer stored in the developer tank 421. The fixing unit 372 includes a fixer tank 422 for storing the fixer, and a fixing roller 375 with a lower portion thereof immersed in the fixer stored in the fixer tank 422. Further, the squeezing unit 373 includes a cleaner tank 423 for storing a cleaning solution, a brush roller 377 with a lower portion thereof immersed in the cleaning solution stored in the cleaner tank 423, and a squeeze roller 376 in contact with the brush roller 377.

The developing roller 374 supplies the developer to the plate P mounted peripherally of the first or second plate cylinder 11 or 12. The fixing roller 375 supplies the fixer to the plate P on the first or second plate cylinder 11 or 12. The squeeze roller 376 removes the developer and fixer from the plate P. The brush roller 377 cleans the squeeze roller 376 with the cleaning solution.

The developing roller 374, fixing roller 375 and squeeze roller 376 are movable by a roller moving mechanism, described hereinafter, between a position for contacting the plate P mounted on the first or second plate cylinder 11 or 12, and a position separated from the plate P. Further, the developing roller 374, fixing roller 375 and brush roller 377 are rotatable synchronously with one another by a roller rotating mechanism described hereinafter.

In this embodiment, a lithographic plate using the diffusion transfer process (DTR process) is used as plate P. The developer acts as an activator, and the fixer as a stabilizer.

Figure 14:
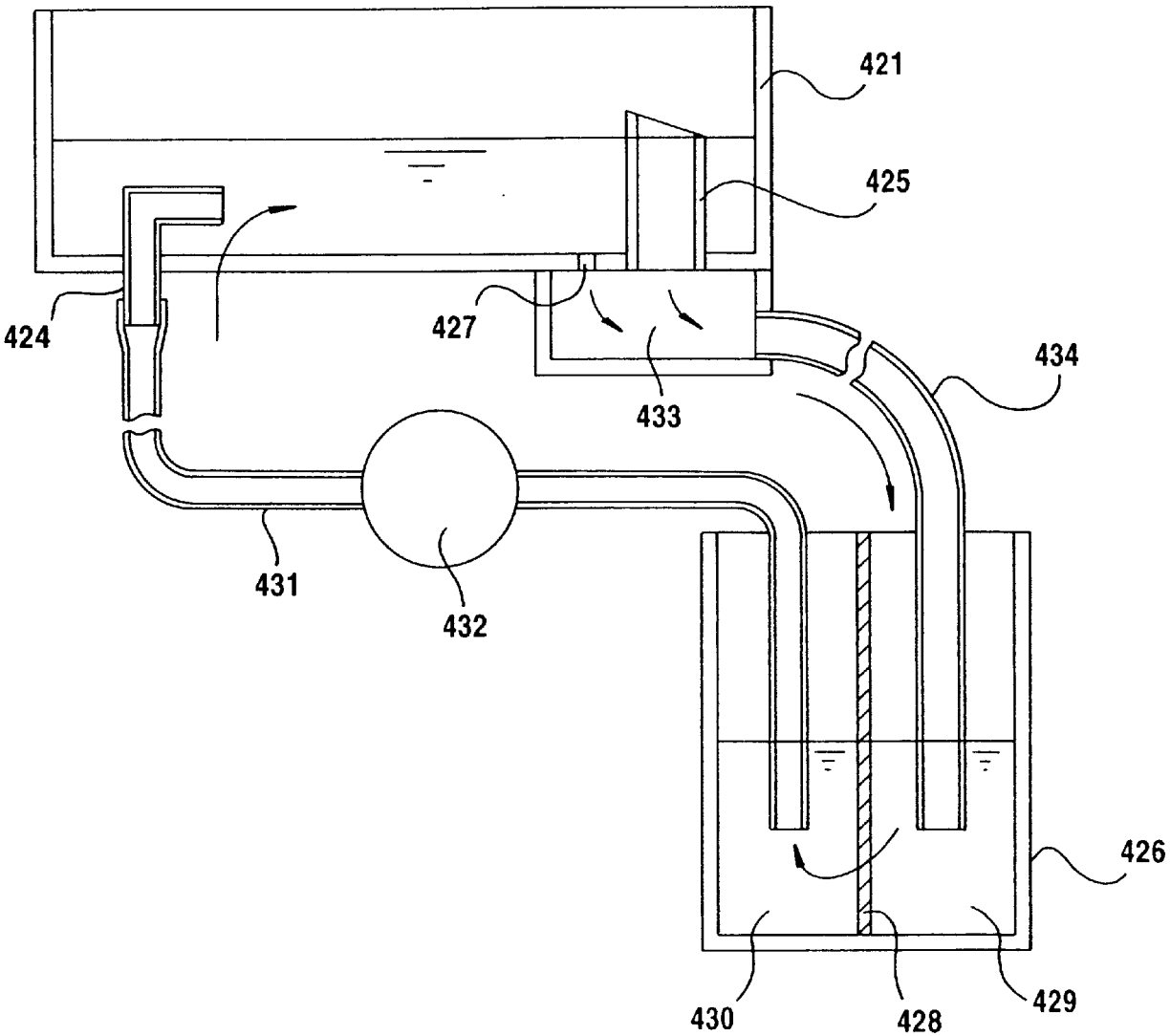
FIG. 14 is a schematic view of a mechanism for circulating a developer through developer tanks.

A mechanism for circulating the developer through the developer tank 421 of the developing unit 371 will be described first. FIG. 14 is a schematic view of the developer circulating mechanism.

This developing unit 371 stores the developer in the developer tank 421 only when carrying out a developing process. This measure is taken to avoid the prepress and printing mechanisms such as the first and second blanket cylinders 13 and 14 and the image recorder 25 being adversely affected by the vapor of the developer.

As shown in FIG. 14, the developer tank 421 has, communicating therewith through a bottom thereof, a feed pipe 424 for feeding the developer and an overflow pipe 425 for maintaining the developer at a fixed level. Further, the developer tank 421 has a drain port 427 formed in the bottom thereof.

Below the developer tank 421 is another developer tank 426 for storing the developer. This developer tank 426 is divided by a filter 428 into a first chamber 429 and a second chamber 430. The developer tank 426 contains a panel heater not shown, and has an upper opening sealed by a cover not shown.

The second chamber 430 of the developer tank 426 is connected to the feed pipe 424 through a supply pipe 431.

A pump 432 is mounted in an intermediate position of the supply pipe 431. The developer tank 421 has a liquid receptacle 433 disposed below the overflow pipe 425 and drain port 427 for receiving the developer flowing out through the overflow pipe 425 and drain port 427. The liquid receptacle 433 communicates with the first chamber 429 of the developer tank 426 through a collecting pipe 434.

The pump 432 is a variable displacement, self-contained type pump. The flow rate through the pump 432 is switchable, under control of the control unit 140 noted hereinbefore, between a first flow rate higher than a flow rate of the developer flowing through the drain port 427 down to the liquid receptacle 433 and lower than a maximum flow rate of the developer flowing through the drain port 427 and overflow pipe 425 down to the liquid receptacle 433, and a second flow rate significantly higher than the first flow rate.

With this construction, the entire developer is stored in the developer tank 426 before start of a developing process. For starting a developing process, the pump 432 is driven to supply the developer at the second flow rate from the developer tank 426 to the developer tank 421. Part of the developer supplied to the developer tank 421 flows out through the drain port 427. As noted above, the second flow rate is significantly higher than the flow rate of the developer flowing through the drain port 427 down to the liquid receptacle 433. Consequently, the level of the developer in the developer tank 421 rises rapidly. The developer eventually flows out through the overflow pipe 425 to the liquid receptacle 433, to be collected in the developer tank 426 through the collecting pipe 434.

Upon lapse of a fixed time after starting to drive the pump 432, or upon detection of the developer passing through the collecting pipe 434, the control unit 140 reduces the flow through the pump 432 from the second flow rate to the first flow rate. As noted above, the first flow rate is higher than the flow rate of the developer flowing through the drain port 427 down to the liquid receptacle 433 and lower than the maximum flow rate of the developer flowing through the drain port 427 and overflow pipe 425 down to the liquid receptacle 433. Thus, the developer may be circulated while the developer in the developer tank 421 is maintained at the fixed level by the overflow pipe 425.

In this state, as described hereinafter, the developing roller 374 is placed in contact with the plate P mounted on the first or second plate cylinder 11 or 12, to apply the developer to the plate P.

When the developing process is completed for the plate P, the control unit 140 stops the pump 432. As a result, the developer flows out through the drain port 427 formed in the bottom of the developer tank 421 to the liquid receptacle 433. The entire developer is collected in the developer tank 426 through the collecting pipe 434. Thus, the vapor or the like generating from the developer is prevented from affecting the prepress and printing mechanisms such as the first and second blanket cylinders 13 and 14 and the image recorder 25.

To prevent, with increased effect, the vapor of the developer from affecting the prepress and printing mechanisms, a construction may be provided for exhausting the vapor from adjacent the developer tank 426.

The above description has been made in relation only to the developer tank 421 for storing the developer acting as a processing solution. Similar structures for collecting the fixer and cleaning solution acting as other processing solutions are provided for the fixer tank 422 and cleaner tank 423.

Figure 15:
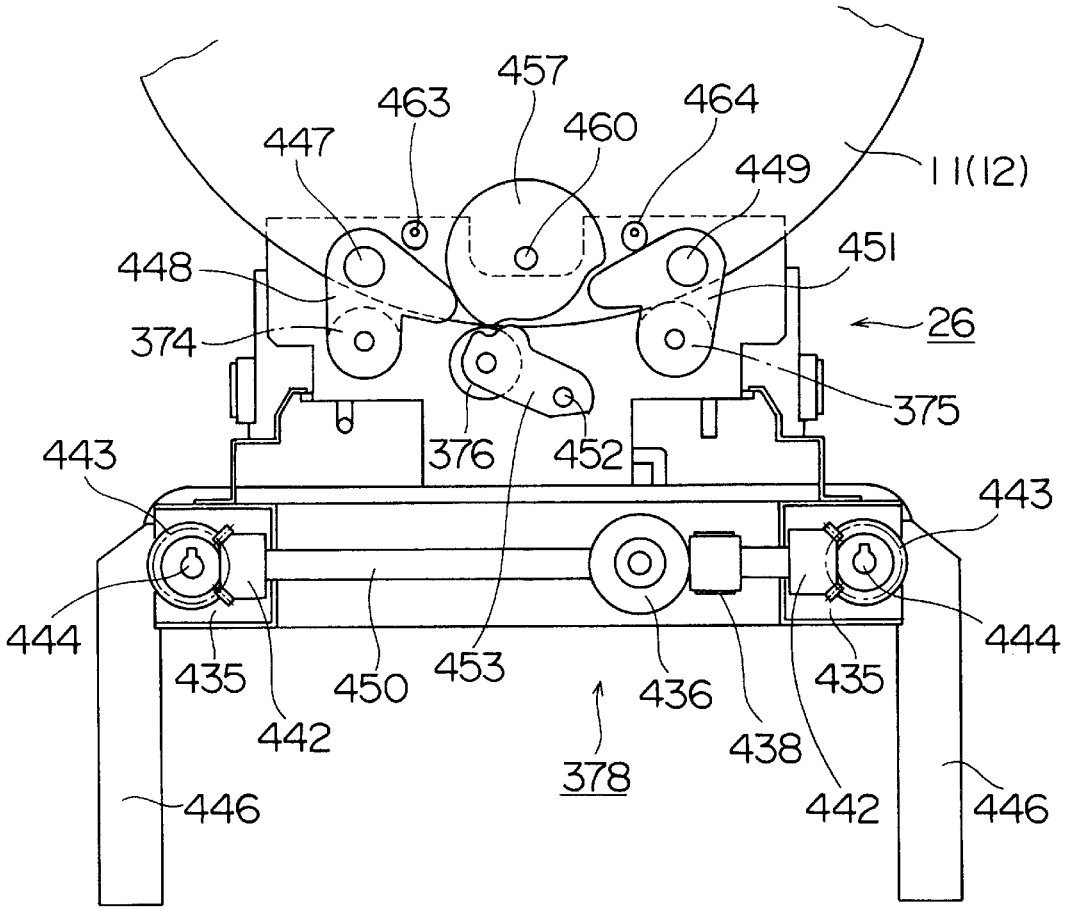
FIG. 15 is a side view of a developing device moving mechanism and a roller moving mechanism.
Figure 16:
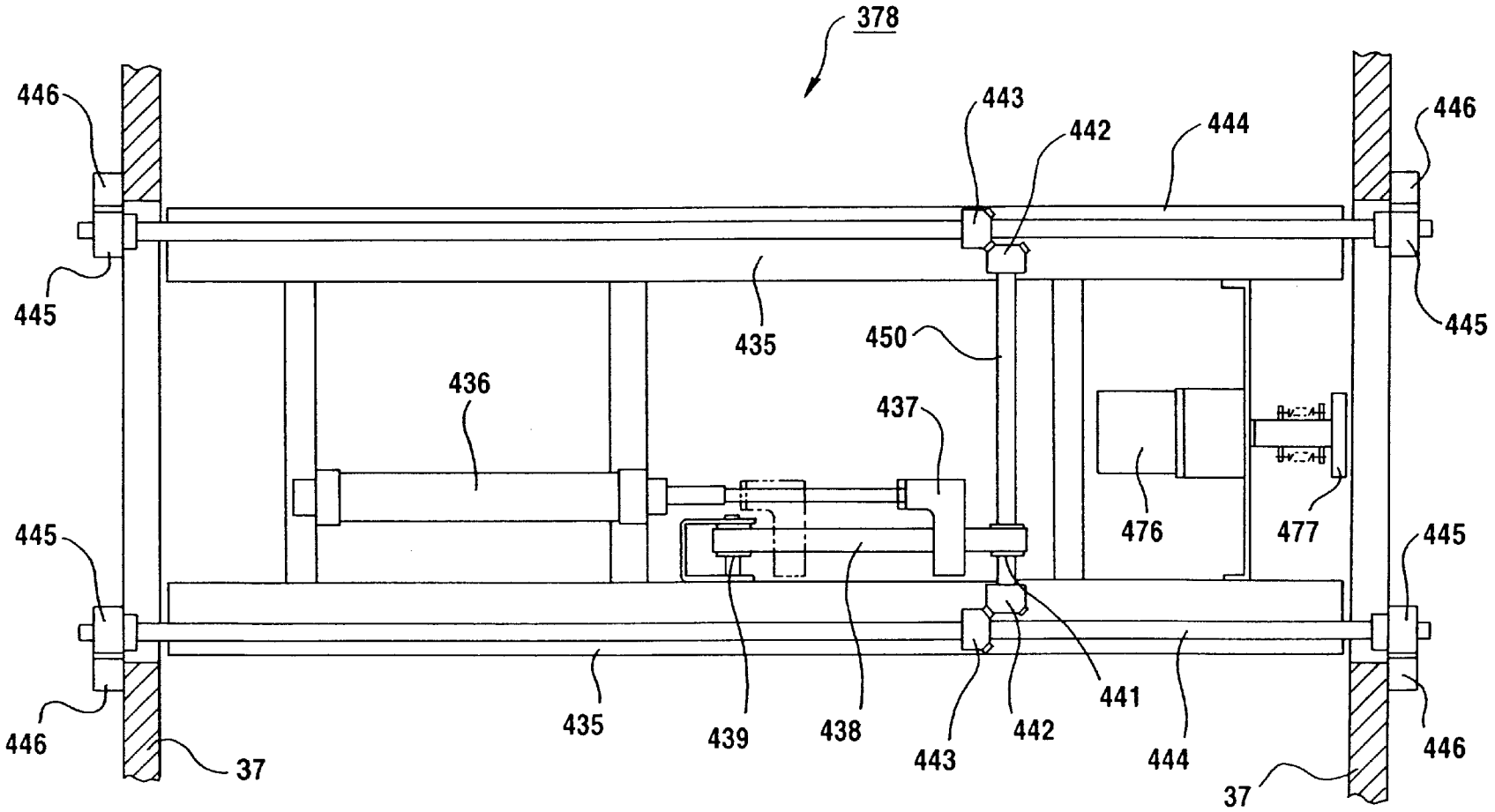
FIG. 16 is a plan view of the developing device moving mechanism.

The construction of developing device moving mechanism 378 will be described next. This moving mechanism 378 moves the developing unit 371, fixing unit 372 and squeezing unit 373 between the developing position shown in solid lines and the retracted position shown in phantom lines in FIG. 1. FIG. 15 is a side view showing the developing device moving mechanism 378 along with the roller moving mechanism. FIG. 16 is a plan view of the developing device moving mechanism 378.

The developing unit 371, fixing unit 372 and squeezing unit 373 of the developing device 26 are upwardly movably arranged on a base block 435 of the developing device moving mechanism 378. An air cylinder 436 is disposed on the base block 435. The distal end of a cylinder rod of the air cylinder 436 carries a guide plate 437 coupled to a synchronizing belt 438 wound around a pair of pulleys 439 and 441. The guide plate 437 is driven by the air cylinder 436 to reciprocate between a position shown in a solid line and a position shown in a phantom line in FIG. 16.

The pulley 441 is fixed to a shaft 450 having bevel gears 442 at opposite ends thereof. The bevel gears 442 at the opposite ends of shaft 450 are meshed with bevel gears 443 fixed to a pair of shafts 444 having spur gears 445 at opposite ends thereof, respectively. The spur gears 445 at the opposite ends of shafts 444 are meshed with racks 446 fixed to the side plates 37 of the printing apparatus, respectively.

With this construction, when the air cylinder 436 moves the guide plate 437, the movement of synchronizing belt 438 wound around the pair of pulleys 439 and 441 rotates the shaft 450. The rotation of shaft 450 is transmitted to the spur gears 445 through the bevel gears 442 and 443 and the shafts 444. This rotates the spur gears 445 meshed with racks 446 fixed to the side plates 37 of the printing apparatus. As a result, the developing unit 371, fixing unit 372 and squeezing unit 373 of the developing device 26 are moved vertically between the developing position opposed to the first or second plate cylinder 11 or 12 in the image recording position shown in solid lines in FIG. 15 and FIG. 1, and the retracted position downwardly spaced from the developing position, shown in phantom lines in FIG. 1.

According to this developing device moving mechanism 378, the developing device 26 is raised and lowered by using the racks 446 fixed to the side plates 37 of the printing apparatus, and the spur gears 445 meshed with the racks 446. No lift mechanism occupies a space above or below the developing device 26. Thus, the developing device 26 may be raised and lowered effectively even where, as in the printing apparatus in this embodiment, the blanket cleaning device 29 is disposed below the developing device 26.

The construction of the roller moving mechanism will be described. This roller moving mechanism moves the developing roller 374, fixing roller 375 and squeeze roller 376 between the position for contacting the plate P mounted on the first or second plate cylinder 11 or 12, and the position separated from the plate P.

As shown in FIG. 15, the developing roller 374 is supported by an approximately V-shaped arm 448 pivotable about an axis 447. The fixing roller 375 is supported by an approximately V-shaped arm 451 pivotable about an axis 449. Further, the squeeze roller 376 is supported by an arm 453 pivotable about an axis 452. A main body of the printing apparatus supports a cam 457 rotatable about an axis 460 for contacting and pivoting each of the above arms 448, 451 and 453.

Figure 17:
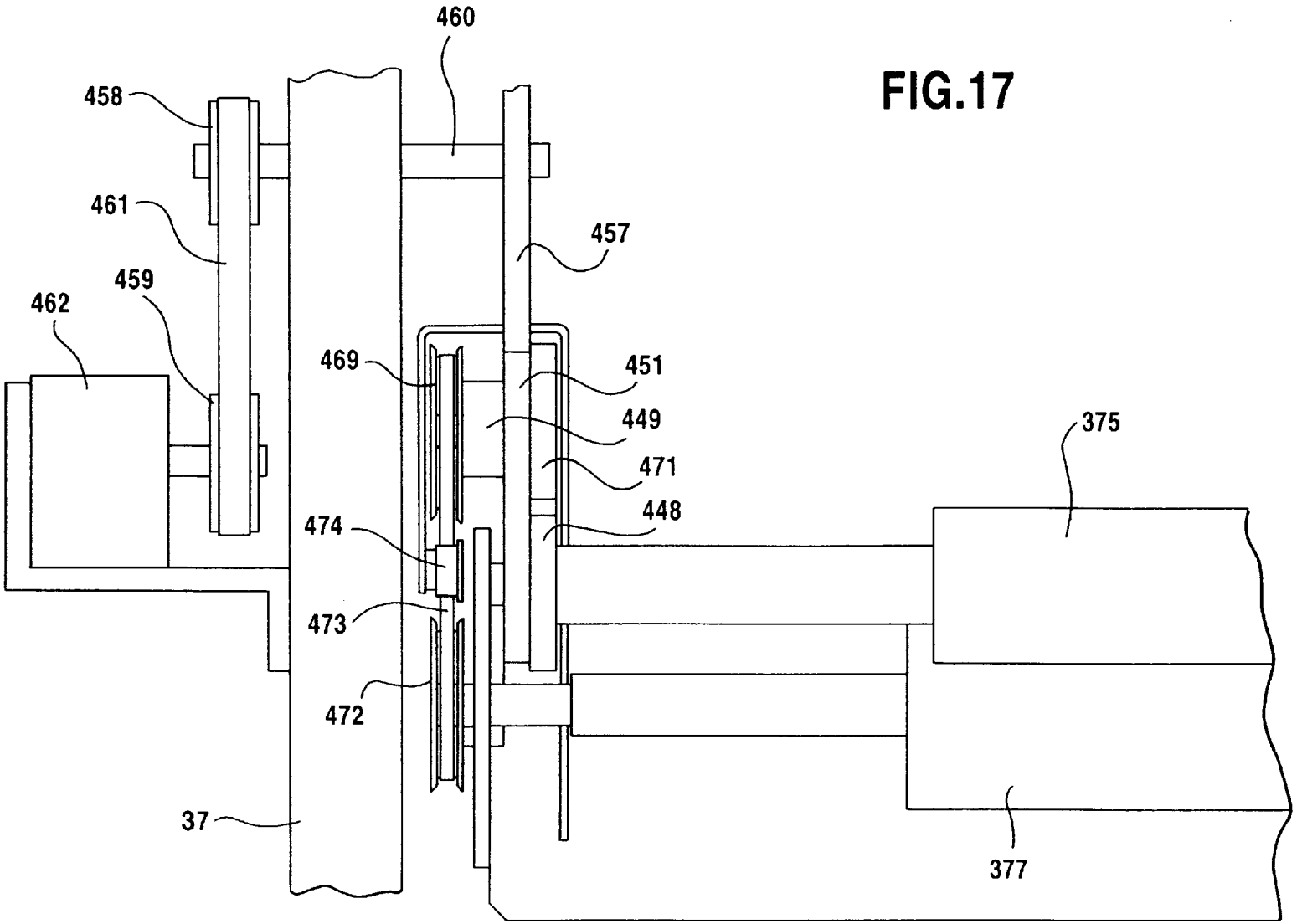
FIG. 17 is a front view of a principal portion of the roller moving mechanism.

As shown in FIG. 17, the axis 460 providing the center of rotation of the cam 457 extends through a side plate 37 of the main body of the printing apparatus. The axis 460 is connected through a pair of pulleys 458 and 459 and a synchronizing belt 461 to a motor 462 attached to the side plate 37. Thus, the cam 457 is rotatable by the motor 462.

Figure 20:
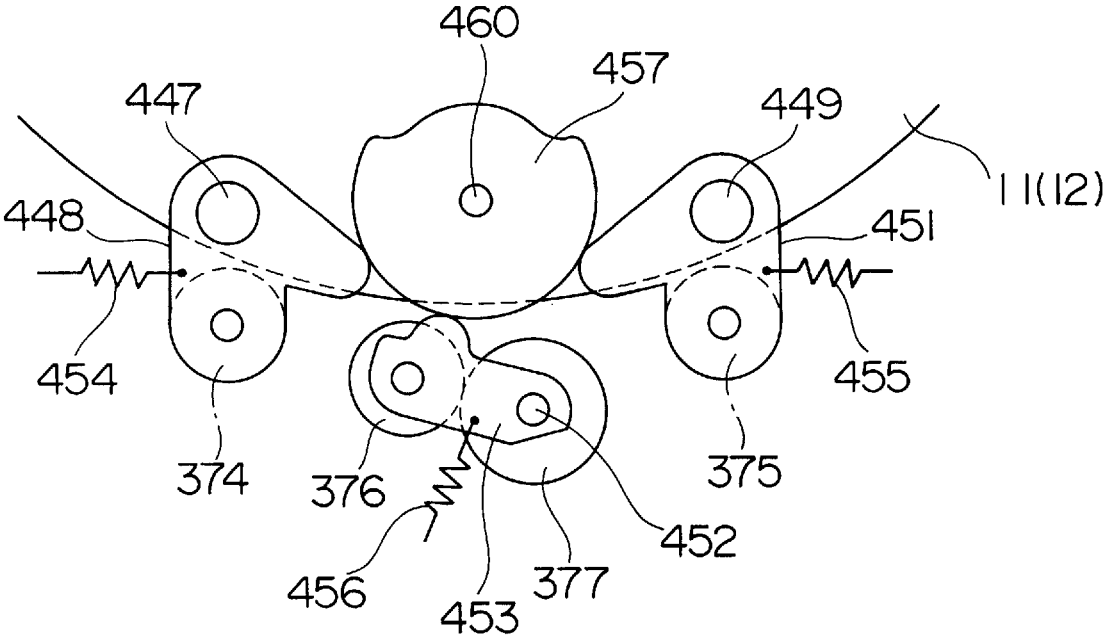
FIG. 20 is an explanatory view showing pivotal movements of arms caused by a cam.

As shown in FIG. 20, the arm 448 is biased by a spring 454 in a direction to contact the cam 457, i.e. in a direction to place the developing roller 374 in contact with the plate P mounted peripherally of the first or second plate cylinder 11 or 12. The arm 451 is biased by a spring 455 in a direction to contact the cam 457, i.e. in a direction to place the fixing roller 375 in contact with the plate P mounted on the first or second plate cylinder 11 or 12. Further, the arm 453 is biased by a spring 456 in a direction to contact the cam 457, i.e. in a direction to place the squeeze roller 376 in contact with the plate P mounted on the first or second plate cylinder 11 or 12.

According to this roller moving mechanism, the cam 457 may be rotated to reciprocate the developing roller 374 between an applying position in contact with the plate P mounted on the first or second plate cylinder 11 or 12, and a retracted position spaced from the applying position. Similarly, the fixing roller 375 may be reciprocated between an applying position in contact with the plate P mounted on the first or second plate cylinder 11 or 12, and a retracted position spaced from the applying position. The squeeze roller 376 may also be reciprocated between a squeezing position in contact with the plate P mounted on the first or second plate cylinder 11 or 12, and a retracted position spaced from the squeezing position.

Figure 21:
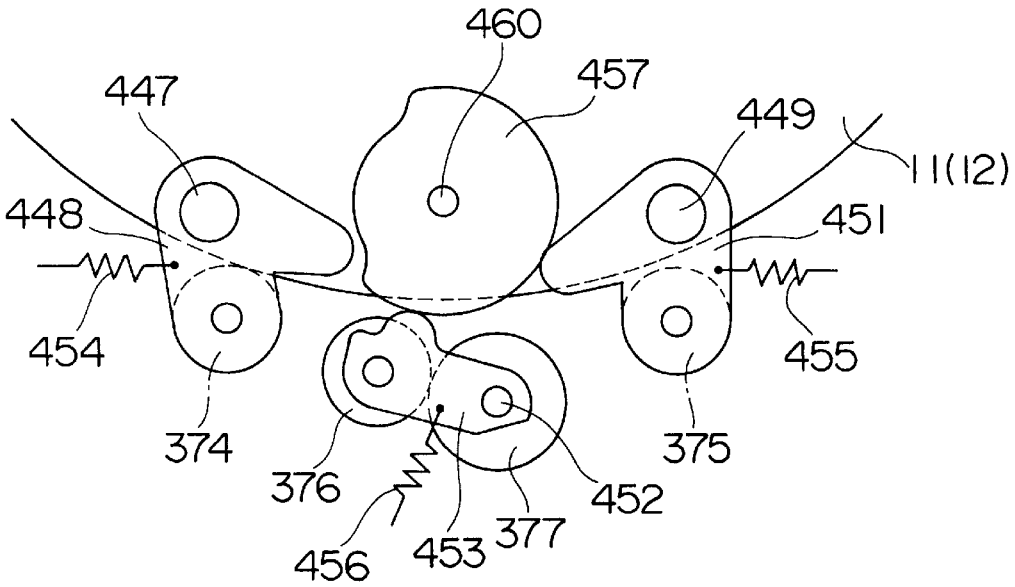
FIG. 21 is another explanatory view showing pivotal movements of the arms caused by the cam.

Specifically, when the respective arms 448, 451 and 453 contact a bulge of cam 457, as shown in FIG. 20, the developing roller 374, fixing roller 375 and squeeze roller 376 are separated from the plate P mounted peripherally of the first or second plate cylinder 11 or 12. With rotation of the cam 457 from this position, a recess of cam 457 moves to a position opposed to the arm 448 as shown in FIG. 21. The cam 457 and arm 448 are now out of contact with each other. Then, the arm 448 pivots to place the developing roller 374 in contact with the plate P mounted peripherally of the first or second plate cylinder 11 or 12.

Similarly, with rotation of the cam 457, the recess of cam 457 may move to a position opposed to the arm 451, whereby the cam 457 and arm 451 no longer contact each other. Then, the arm 451 pivots to place the fixing roller 375 in contact with the plate P mounted on the first or second plate cylinder 11 or 12. Further, with rotation of cam 457, the recess of cam 457 may move to a position opposed to the arm 453, whereby the cam 457 and arm 453 no longer contact each other. Then, the arm 453 pivots to place the squeeze roller 376 in contact with the plate P mounted on the first or second plate cylinder 11 or 12.

Each of the arms 448 and 451 freed from the contact with the cam 457 is movable by an amount regulated by an eccentric member 463 or 464 shown in FIG. 15. Thus, by adjusting eccentricity of the eccentric member 463 or 464, the developing roller 374 or fixing roller 375 may contact the plate P mounted on the first or second plate cylinder 11 or 12 with a pressure adjusted to a value appropriate to the process.

The construction of the roller rotating mechanism will be described next. This roller rotating mechanism synchronously rotates the developing roller 374, fixing roller 375 and brush roller 377.

Figure 18:
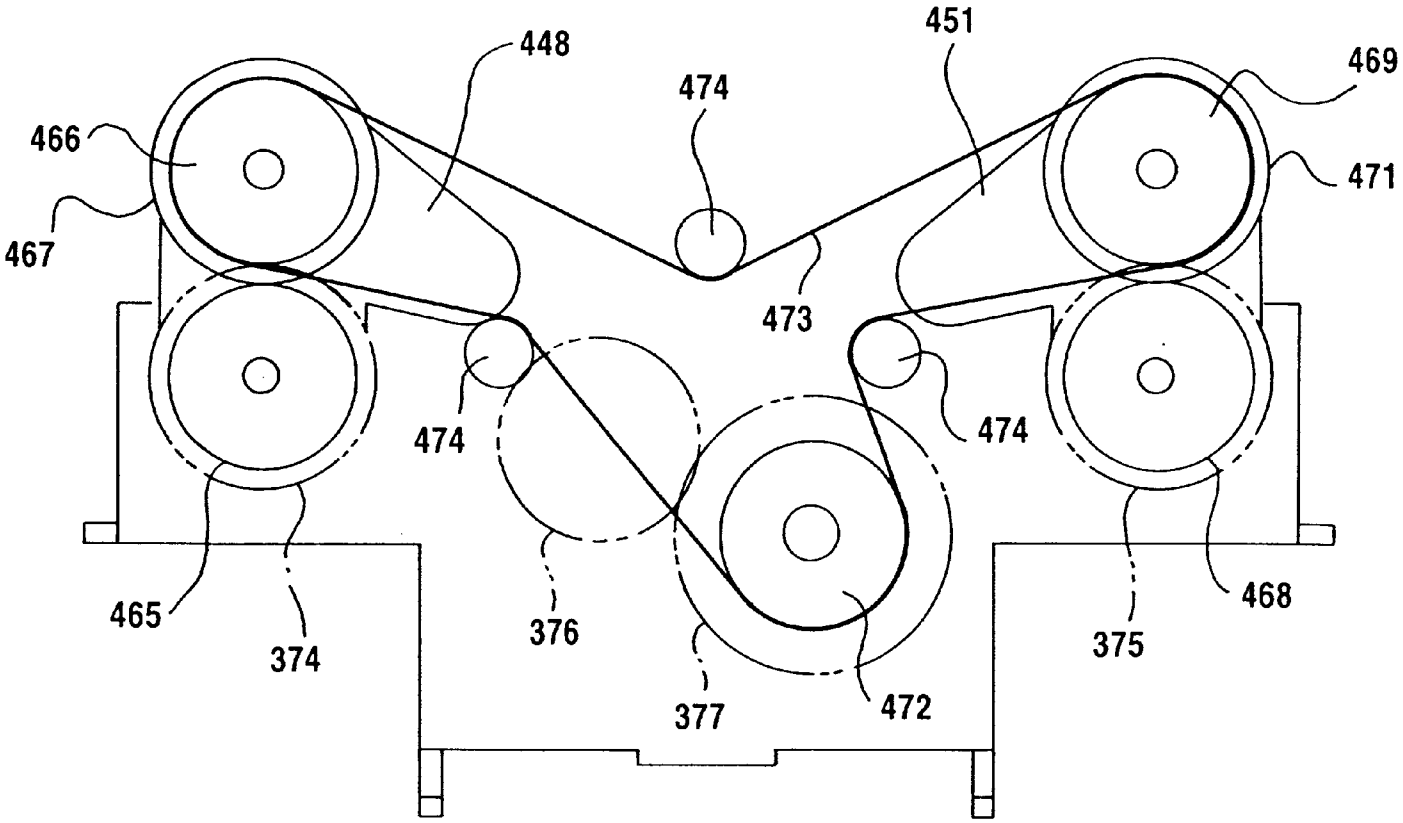
FIG. 18 is a side view of the principal portion of the roller moving mechanism.

As shown in FIG. 18, the developing roller 374 has a gear 465 attached to one end thereof. The gear 465 is meshed with a gear 467 connected to a pulley 466 coaxial with the axis 447 shown in FIG. 15. As shown in FIGS. 17 and 18, the fixing roller 375 has a gear 468 attached to one end thereof The gear 468 is meshed with a gear 471 connected to a pulley 469 coaxial with the axis 449 shown in FIGS. 15 and 17.

Further, the brush roller 377 has a pulley 472 attached to one end thereof. The pulley 472 is connected to the above pulleys 466 and 469 through a synchronizing belt 473. Thus, the brush roller 377 is rotatable synchronously with, and in an opposite direction to, the developing roller 374 and fixing roller 375. Reference numeral 474 in FIGS. 17 and FIG. 18 denotes tension pulleys.

Figure 19:
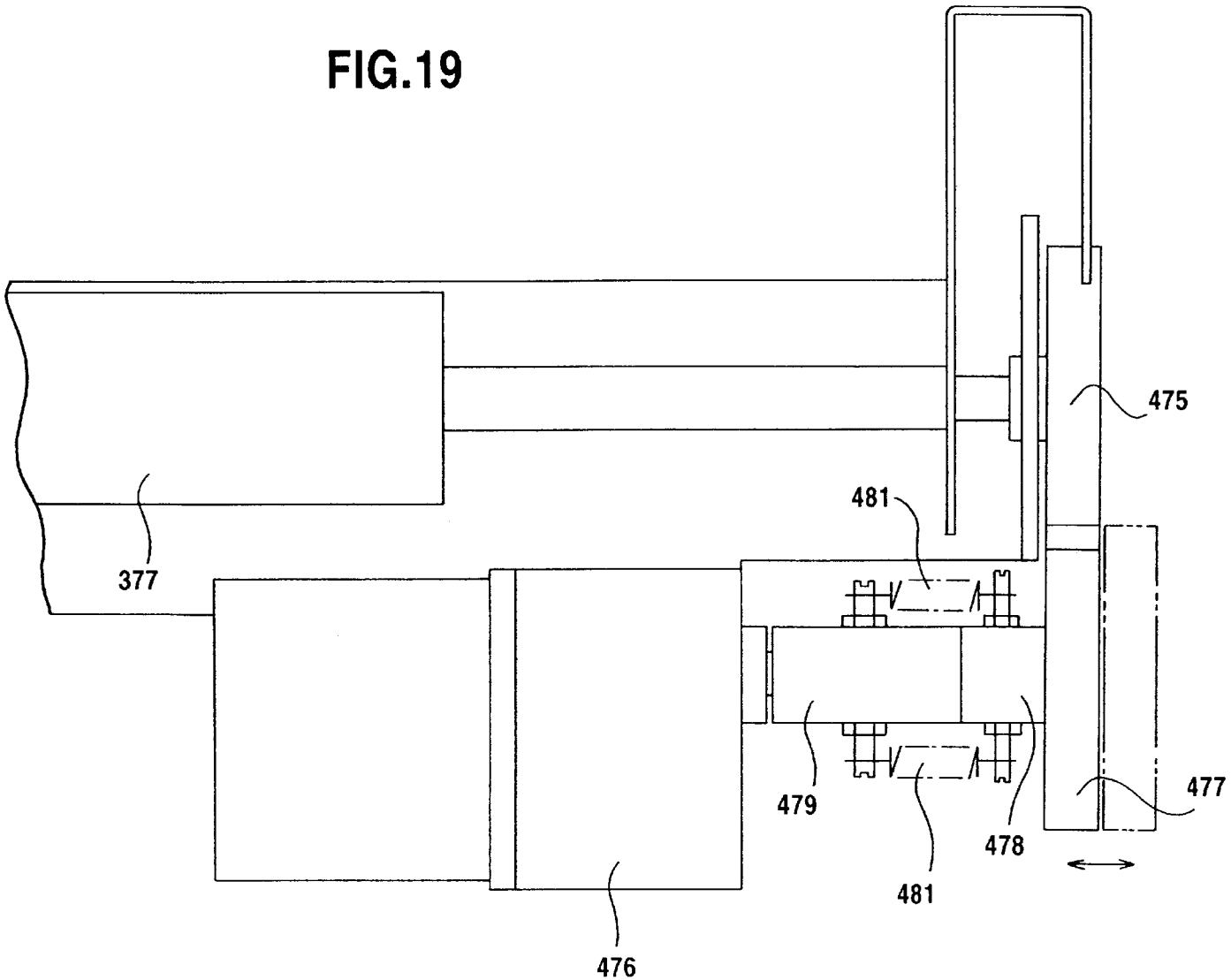
FIG. 19 is a front view of a motor and adjacent components for rotating a brush roller.

As shown in FIG. 19, the brush roller 377 has a gear 475 attached to the other end thereof remote from the pulley 472. The gear 475 is meshed with a gear 477 rotatable by a drive motor 476. Thus, the brush roller 377 is rotatable by the drive motor 476. The developing roller 374 and fixing roller 375 are rotatable synchronously with the brush roller 377.

As noted hereinbefore, the developing unit 371, fixing unit 372 and squeezing unit 373 of the developing device 26 are upwardly movably arranged on the base block 435 of the developing device moving mechanism 378. In time of upward movement, the developing unit 371, fixing unit 372 and squeezing unit 373 are drawn leftward in FIG. 19. In this state, the gear 475 is out of mesh with the gear 477. When the developing unit 371, fixing unit 372 and squeezing unit 373 are moved rightward in FIG. 19, to reinstate the three units 371, 372 and 373 on the base block 435, the gears 475 and 477 could collide with each other to sustain damage.

To avoid such an inconvenience, the gear 477 has a shaft 478 axially movable toward and away from a drive shaft 479 coupled to the motor 476, with a plurality of springs 481 arranged peripherally of the shaft 478 and drive shaft 479 for biasing the two shafts 478 and 479 toward each other. With this construction, when the gears 475 and 477 collide with each other, the gear 477 moves against the biasing force of springs 481 to a position shown in a two-dot chain line in FIG. 19, thereby avoiding damage to the gears 475 and 477.

A developing operation of the developing device 26 having the above construction will be described next.

The first or second plate cylinder moving mechanism 31 or 32 first moves the first or second plate cylinder 11 or 12 to the image recording position. Thereafter, the developing device moving mechanism 378 moves the developing device 26 to the developing position opposed to the first or second plate cylinder 11 or. 12.

The cam 457 is set beforehand to an angular position having the bulge facing downward as shown in FIG. 20. Thus, when the developing device 26 is moved to the developing position, as shown in FIG. 20, the arms 448, 451 and 453 are pressed by the cam 457, whereby the developing roller 374, fixing roller 375 and squeeze roller 376 remain separated from the surface of plate P mounted on the first or second plate cylinder 11 or 12.

In this state, the image recorder 25 records images on the plate P while the motor 75 of the plate cylinder rotating mechanism 30 shown in FIG. 8 rotates the first or second plate cylinder 11 or 12 counterclockwise in FIG. 20 and at a speed suited for image recording.

Upon completion of the image recording by the image recorder 25, the motor 75 is operated to rotate the first or second plate cylinder 11 or 12 at a speed suited for a developing process described hereinafter. When the forward end of plate P mounted on the first or second plate cylinder 11 reaches a position immediately before being opposed to the developing roller 374, the cam 457 is rotated to the position shown in FIG. 21. As a result, the cam 457 and arm 448 move out of contact with each other, whereby the developing roller 374 moves to the applying position in contact with the plate P. Prior to this, the motor 476 starts rotating the developing roller 374 along with the fixing roller 375 and brush roller 377 in the same direction as the direction of rotation of the first or second plate cylinder 11 or 12 (counterclockwise in FIG. 20).

Figure 25:
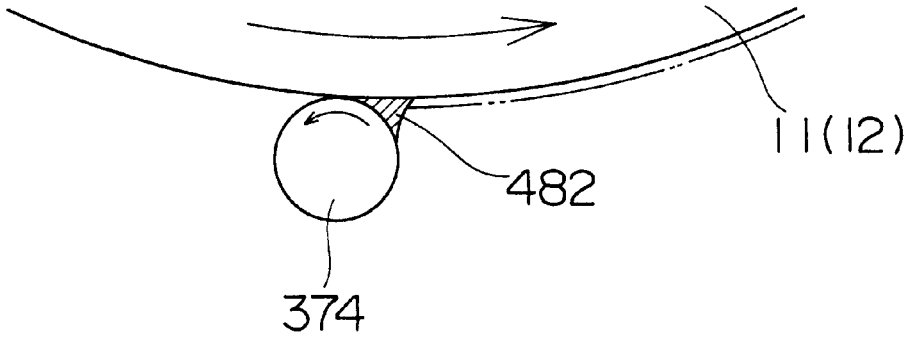
FIG. 25 is an explanatory view showing a developer applying operation of a developing roller.

In this state, as shown in FIG. 25, the surface of developing roller 374 moves in contact with and counter to the plate P mounted on the first or second plate cylinder 11 or 12. With the rotation of developing roller 374, the developer picked up by the developing roller 374 from the developer tank 421 forms a puddle 482 trailing the contact between the plate P and developing roller 374. The puddle 482 of the developer spreads into a thin film of the developer uniformly over the surface of plate P as shown in a two-dot chain line in FIG. 25. As a result, the plate P is uniformly developed by the developer.

Figure 22:
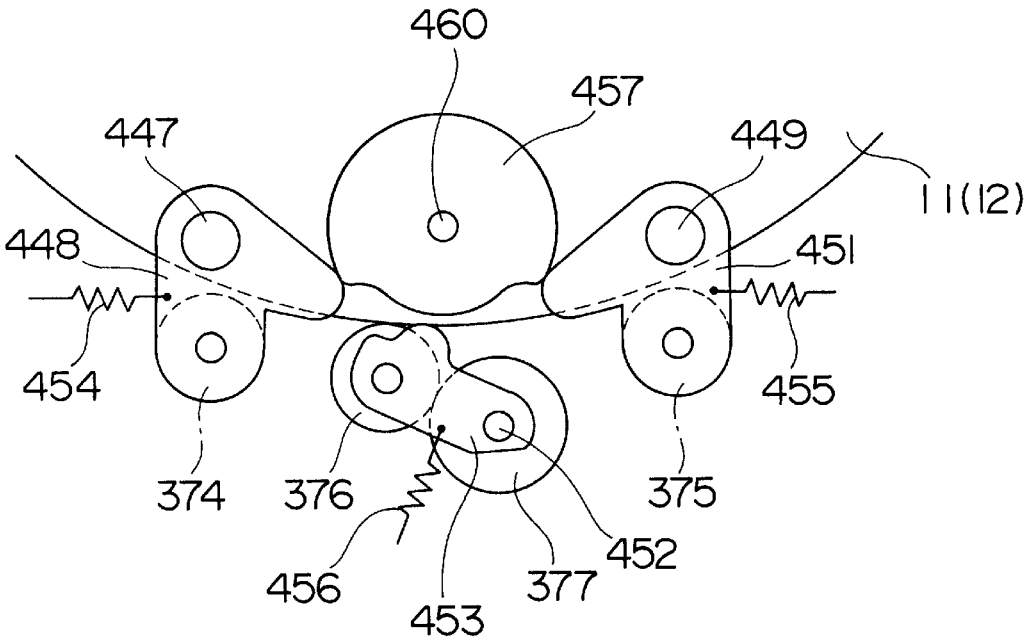
FIG. 22 is a further explanatory view showing pivotal movements of the arms caused by the cam.

In this state, the first or second plate cylinder 11 or 12 continues rotating, whereby the developer is applied to a necessary region of plate P. When the rear end of plate P mounted on the first or second plate cylinder 11 or 12 has moved past a position for contacting the squeeze roller 376, the cam 457 is rotated temporarily to the position shown in FIG. 22. As a result, the developing roller 374 moves to the retracted position away from the surface of plate P, and the squeeze roller 376 moves to the squeezing position in contact with the surface of plate P. A predetermined spacing (socalled a cylinder gap) is formed between the forward end and rear end of plate P. Thus, when the rear end of plate P reaches the position for contacting the squeeze roller 376, the developer is not re-applied to the forward end of plate P.

Figure 23:
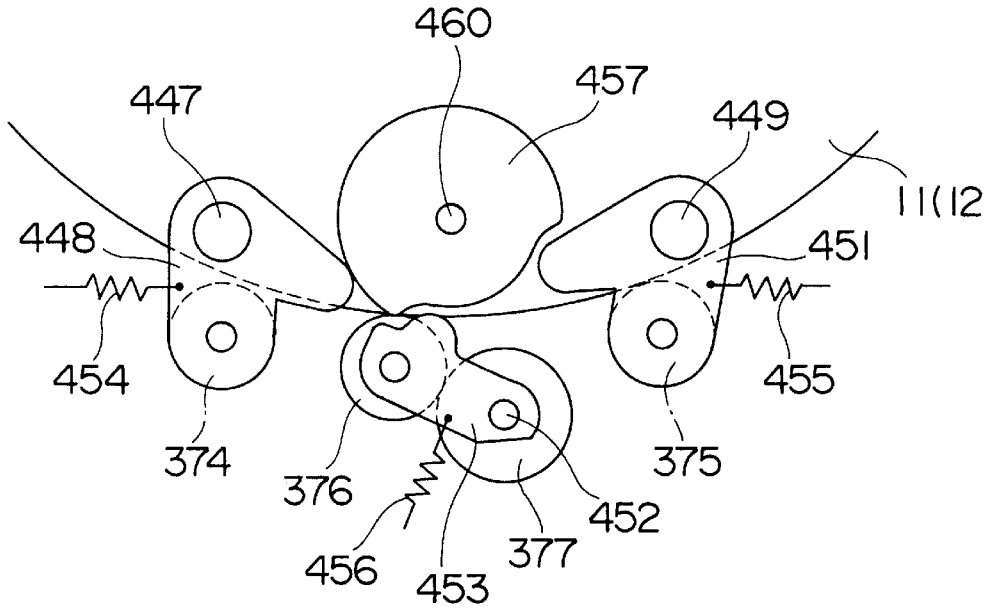
FIG. 23 is a still further explanatory view showing pivotal movements of the arms caused by the cam.

When the rear end of plate P mounted on the first or second plate cylinder 11 or 12 has moved past a position opposed to the fixing roller 375, the cam 457 is rotated to the position shown in FIG. 23. As a result, the arm 451 moves out of contact with the cam 457, whereby the fixing roller 375 also moves into contact with the plate P. As noted hereinbefore, the fixing roller 375 and brush roller 377 rotate with the developing roller 374 in the same direction as the direction of rotation of the first or second plate cylinder 11 or 12.

As the first or second plate cylinder 11 or 12 continues to rotate in this state, the squeeze roller 376 squeezes the developer off the plate P, and the fixing roller 375 applies the fixer from the fixer tank 422 to the surface of plate P.

Figure 26:
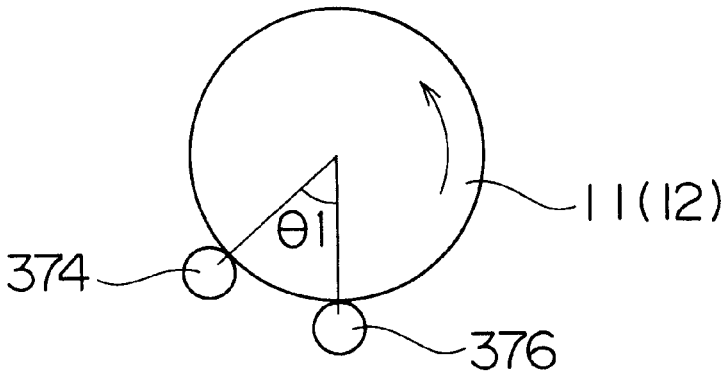
FIG. 26 is an explanatory view showing an angle between the developing roller and a squeeze roller.

The plate P mounted peripherally of the first or second plate cylinder 11 or 12 rotates through an angle $\theta$ (=360°+ $\theta 1$) from the time the plate P contacts the developing roller 374 which applies the developer to the plate P, to the time the plate P contacts the squeeze roller 376 which squeezes the developer off the plate P. The angle $\theta 1$ is an angle between the developing roller 374 and squeeze roller 376 around the first or second plate cylinder 11 or 12 as shown in FIG. 26.

The turning angle velocity of the first or second plate cylinder 11 or 12 driven by the plate cylinder rotating mechanism 30 is $\theta/T$, where T is a time required for the developing process of plate P by the developer. Thus, the plate P is developed promptly and properly after the developer is applied thereto by the developing roller 374 until the developer is squeezed off by the squeeze roller 376.

Even after the developer is squeezed off the plate P by the squeeze roller 376, a small quantity of the developer remains on the surface of plate P. Consequently, a minor developing reaction continues on the plate P. However, this developing reaction is trivial compared with a developing reaction occurring after the developer is applied from the developing roller 374 to the plate P until the developer is squeezed off the plate P by the squeeze roller 376. Taking into account the fixing process carried out immediately thereafter, the developing reaction occurring after the developer is squeezed off by the squeeze roller 376 is in substance negligible.

In the above squeezing step, the squeeze roller 376 in contact with the plate P mounted on the first or second plate cylinder 11 or 12 rotates with but in the opposite direction to the first or second plate cylinder 11 or 12. On the other hand, the brush roller 377 in contact with the squeeze roller 376 rotates in the opposite direction to the first or second plate cylinder 11 or 12. Thus, the squeeze roller 376 is cleaned through contact with the brush roller 377 soaked with the cleaning solution from the cleaner tank 423 and rotating in the same direction as the squeeze roller 376. As a result, the squeeze roller 376 in a constantly cleaned state squeezes the developer off the plate P. As used herein, the term cleaning solution includes cleaning water not containing any particular chemical.

The fixing roller 375 rotates with the developing roller 374 in the same direction as the first or second plate cylinder 11 or 12. In the fixer applying step, as in the case of applying the developer by the developing roller 374 shown in FIG. 25, the fixer picked up by the fixing roller 375 from the fixer tank 422 forms a puddle trailing the contact between the plate P and fixing roller 375. The puddle of the fixer spreads into a thin film uniformly over the surface of plate P. As a result, uniform fixing treatment is effected for the plate P by the fixer.

In this state, the first or second plate cylinder 11 or 12 continues rotating, whereby the fixer is applied to a necessary region of plate P. When the rear end of plate P mounted on the first or second plate cylinder 11 or 12 has moved past the position for contacting the fixing roller 375, the cam 457 is rotated to the position shown in FIG. 22. As a result, the fixing roller 375 moves to the retracted position away from the surface of plate P, and only the squeeze roller 376 operates to squeeze the fixer off the plate P.

The squeeze roller 376 is constantly cleaned by the brush roller 377 also in time of this fixer removal.

As the first or second plate cylinder 11 or 12 continues to rotate in this state, the squeeze roller 376 removes the fixer from the plate P. Then, the developing device moving mechanism 378 lowers the developing device 26.

As in the developing process, the time from application of the fixer to the plate P to removal of the fixer therefrom should preferably be equalized to the time required for fixation. This is achieved by adjusting the turning angle velocity of the first or second plate cylinder 11 or 12 driven by the plate cylinder rotating mechanism 30. However, the fixing process does not require as strict a time management as the developing process.

In the above embodiment, the developing process is carried out while rotating the first or second plate cylinder 11 or 12 through angle $\theta 1$ after one complete rotation. The developing process may be carried out while rotating the first or second plate cylinder 11 or 12 through angle $\theta 1$ after n rotations (n being an integer 2 or more). In this case, each of the developer and fixer may be applied once or n times.

In the above embodiment, the plate cylinder rotating mechanism 30 rotates the first or second plate cylinder 11 or 12 at the fixed turning angle velocity $\theta/T$. As long as time T is secured from application of the developer from the developing roller 374 to the plate P to removal of the developer by the squeeze roller 376, the first or second plate cylinder 11 or 12 may be stopped temporarily after the developer is applied to the plate P.

Further, the developing process may be carried out within the range of angle θ1 shown in FIG. 26, while the plate cylinder rotating mechanism 30 rotates the first or second plate cylinder 11 or 12 at low speed.

Figure 24:
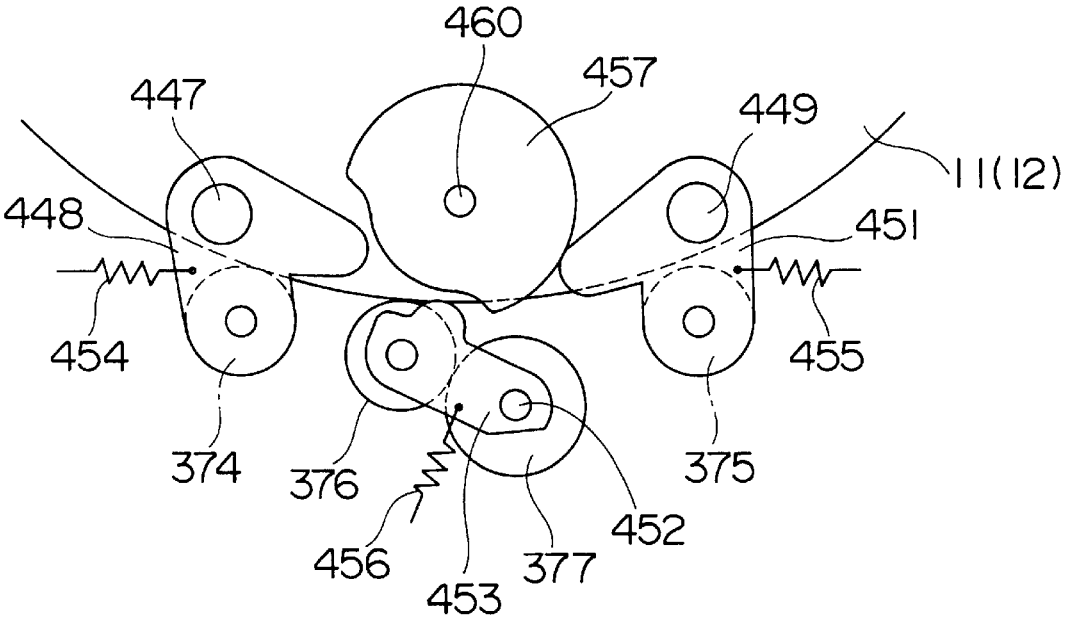
FIG. 24 is a still further explanatory view showing pivotal movements of the arms caused by the cam.

In this case, the cam 457 is rotated to the position shown in FIG. 24 to place the developing roller 374 and squeeze roller 376 in contact with the plate P. In this state, the plate cylinder rotating mechanism 30 rotates the first or second plate cylinder 11 or 12 counterclockwise in FIG. 24. Then, the developing process is carried out from the time the developing roller 374 contacts the plate P and applies the developer thereto to the time the squeeze roller 376 contacts the plate P to remove the developer therefrom.

At this time. the turning angle velocity of the first or second plate cylinder 11 or 12 driven by the plate cylinder rotating mechanism 30 is adjusted so that the period from the time the developing roller 374 contacts the plate P and applies the developer thereto to the time the squeeze roller 376 contacts the plate P to remove the developer therefrom correspond to the time required for development of the plate P by the developer.

Subsequently, the cam 457 is rotated to the position shown in FIG. 23, to place the fixing roller 375 and squeeze roller 376 in contact with the plate P. Then, the plate cylinder rotating mechanism 30 rotates the first or second plate cylinder 11 or 12 clockwise which is reverse to the above. As a result, the fixing process is carried out from the time the fixing roller 375 contacts the plate P and applies the fixer thereto to the time the squeeze roller 376 contacts the plate P to remove the fixer therefrom.

Where, as described above, the developing process and fixing process are carried out within the range of angle θ1 shown in FIG. 26, the first or second plate cylinder 11 or 12 does not make one complete rotation with the developer or fixer applied to the plate P, This provides the advantage of facilitating exhaust of gases generating from the developer and fixer, and minimizing diffusion of the gases to the ambient.

Figure 27:
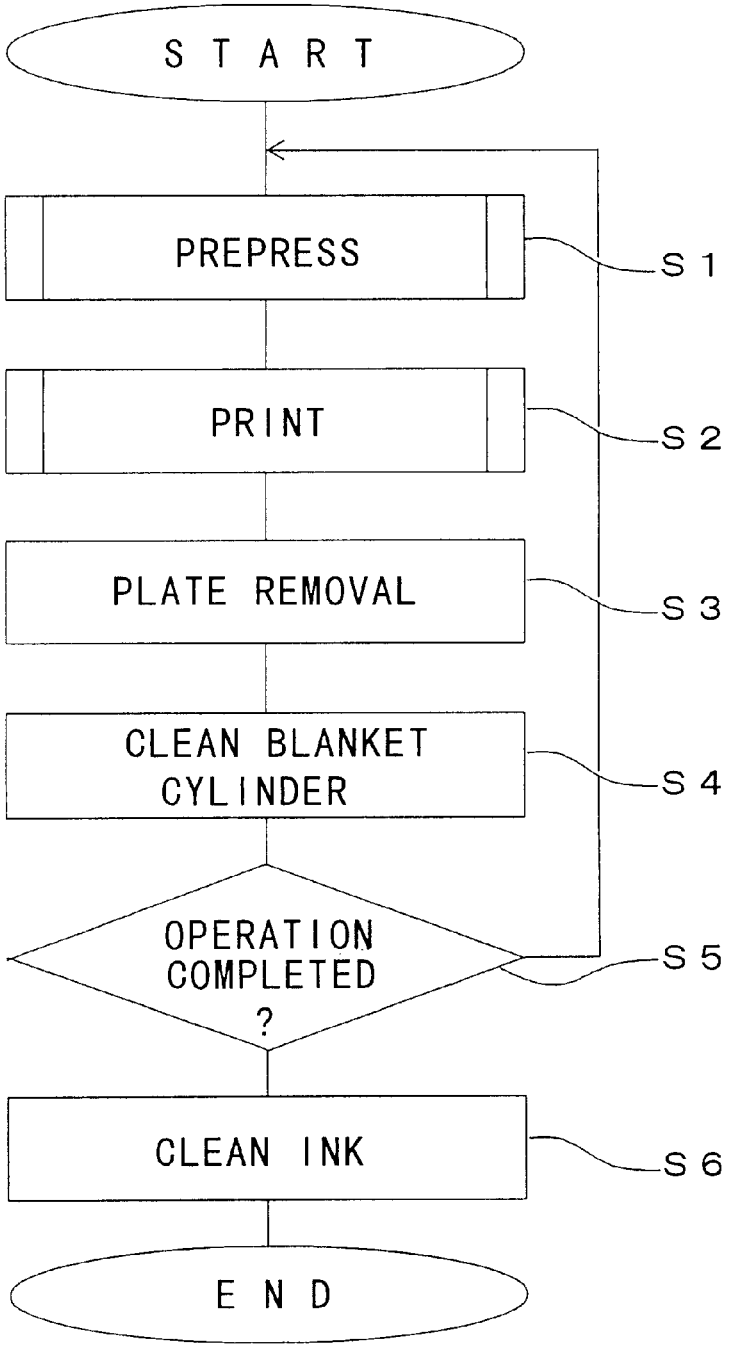
FIG. 27 is a flow chart showing an outline of prepress and printing operations of the printing apparatus.

Prepress and printing operations of the printing apparatus will be described next. FIG. 27 is a flow chart showing an outline of the prepress and printing operations of the printing apparatus. These prepress and printing operations are directed to multicolor printing of printing paper with the four color inks of yellow, magenta, cyan and black.

Figure 28:
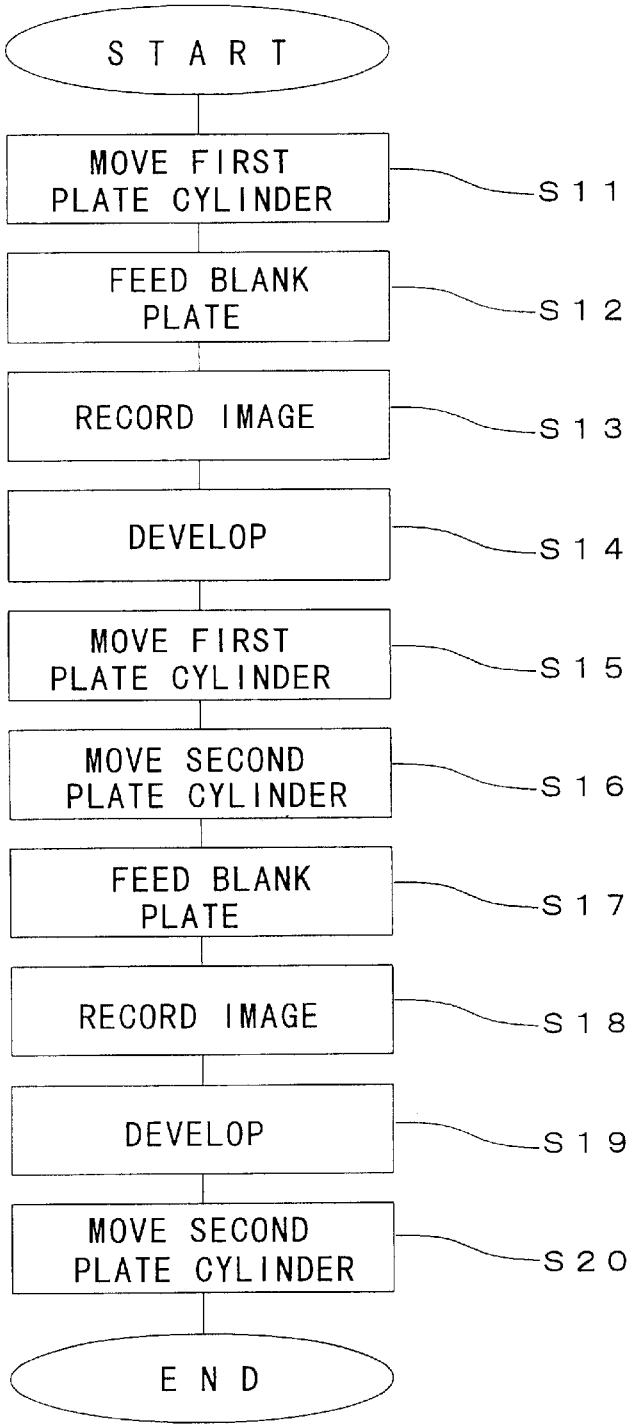
FIG. 28 is a flow chart of a prepress process.

First, the printing apparatus executes a prepress process for recording and developing images on the plates P mounted on the first and second plate cylinders 11 and 12 (step S1). This prepress process follows the steps constituting a subroutine as shown in the flow chart of FIG. 28.

The first plate cylinder 11 is first moved to the image recording position shown in the two-dot chain line in FIG. 1.

(step S11).

Next, a plate P is fed to the outer periphery of the first plate cylinder 11 (step S12). To achieve the feeding of the plate P, the pair of grippers, not shown, grip the forward end of plate P drawn from the supply cassette 63, and the rear end of plate P cut by the cutter 66.

Then, an image is recorded on the plate P mounted peripherally of the first plate cylinder 11 (step S 13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing roller 374 of developing unit 371, the fixing roller 375 of fixing unit 372 and the squeeze roller 376 of squeezing unit 373 into contact with the plate P rotating with the first plate cylinder 11.

Upon completion of the developing step, the first plate cylinder 11 is moved to the first printing position shown in the solid line in FIG. 1 (step S15).

Subsequently, the printing apparatus carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 27, the prepress process is followed by a printing process for printing the printing paper with the plates P mounted on the first and second plate cylinders 11 and 12 (step S2). The printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. The inks fed to the plates P are transferred to the first and second blanket cylinders 13 and 14, respectively.

Then, the printing paper is fed to the paper feed cylinder 16. The printing paper is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 to the paper discharge station 28 along with one of the grippers of the paper discharge cylinder 17, to be discharged therein.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the pawl mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the printing apparatus determines whether or not a further image is to be printed (step S5). If a further printing operation is required, the apparatus repeats steps S1 to S4.

If the printing operation is ended, the printing apparatus cleans the inks (step S6). For cleaning the inks, an ink cleaning device, not shown, provided for each ink feeder 20 removes the ink adhering to the ink rollers 71 and inkwell 72 of each ink feeder 20.

With completion of the ink cleaning step, the printing apparatus ends the entire process.

The foregoing embodiment has been described in relation to a developing process conducted for the plate P mounted peripherally of the first or second plate cylinder 11 or 12. The present invention is applicable also to a printing apparatus for carrying out a developing process for a plate mounted peripherally of a cylinder other than a plate cylinder, such as an impression cylinder or prepress cylinder, as described in Japanese Patent Publication (Unexamined) H9-123402 (1997) or H9-131855 (1997).

In the foregoing embodiment, the fixer is applied after the developer is squeezed off by the squeeze roller 376, Instead, the fixer may be applied after the developer is squeezed off the plate P directly by the fixing roller 375. That is, the fixing roller 375 itself may be used as the developer squeeze roller of this invention.

The present invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 9-284487 filed in the Japanese Patent Office on Sep. 30, 1997, the entire disclosure of which is incorporated herein by reference.

What is claimed is:

1. A printing apparatus for making a plate by recording and developing images thereon, and thereafter printing the images by feeding inks to the plate, said printing apparatus comprising:

a plate cylinder for supporting said plate mounted peripherally thereof;

a plate cylinder rotating mechanism for rotating said plate cylinder;

an image recorder for recording said images on said plate mounted on said plate cylinder; and a developing device for developing said plate mounted on said plate cylinder, said developing device including;

a developing roller reciprocable between an applying position for contacting said plate to apply a developer to said plate mounted peripherally of said plate cylinder, and a retracted position spaced from said applying position; and a squeeze roller reciprocable between a squeezing position for contacting said plate to squeeze said developer applied by said developing roller off said plate mounted peripherally of said plate cylinder, and a retracted position spaced from said squeezing position, wherein said plate cylinder rotating mechanism includes a first plate cylinder rotating mechanism which rotates said plate cylinder when making a plate and a second plate cylinder rotating mechanism which rotates said Plate cylinder when printing, wherein said first plate cylinder rotating mechanism is operable for rotating said plate cylinder such that a period of time from said developing roller contacting said plate mounted on said plate cylinder to apply said developer thereto to said squeeze roller contacting said plate after moving from said retracted position to said squeezing position substantially corresponds to a period of time required for developing said plate with said developer, wherein said first plate cylinder rotating mechanism is operable for rotating said plate cylinder at a turning angle velocity $\theta/T$ after said developing roller contacts said plate to apply said developer thereto, where $\theta$ is an angle through which said plate cylinder rotates to move a position of said plate contacted by said developing roller into contact with said squeeze roller, and T is said period of time required for developing said plate with said developer.

2. A printing apparatus as defined in claim 1, wherein said developing device further includes a developing roller rotating mechanism for rotating said developing roller in a direction in which said plate cylinder is rotated by said plate cylinder rotating mechanism, while said developing roller is maintained in contact with said plate mounted peripherally of said plate cylinder.

3. A printing apparatus as defined in claim 1, wherein said developing device further includes a fixing roller reciprocable between an applying position for contacting said plate to apply a fixer to said plate mounted peripherally of said plate cylinder, and a retracted position spaced from said applying position, said squeeze roller being operable for squeezing also said fixer applied by said fixing roller off said plate.

4. A printing apparatus as defined in claim 3, wherein said squeeze roller is disposed between said developing roller and said fixing roller.

5. A printing apparatus as defined in claim 1, further comprising a developing device moving mechanism for moving said developing device between a developing position opposed to said plate cylinder, and a retracted position spaced from said developing position.

6. A printing apparatus as defined in claim 1, wherein said developing device further includes a cleaning mechanism for cleaning said squeeze roller with cleaning solution.

7. A printing apparatus for making a plate by recording and developing images thereon, and thereafter printing the images by feeding inks to the plate, said printing apparatus comprising:

a plate cylinder for supporting said plate mounted peripherally thereof;

a plate cylinder rotating mechanism for rotating said plate cylinder, the plate cylinder rotating mechanism including a first plate cylinder rotating mechanism which rotates said plate cylinder when making a plate and a second plate cylinder rotating mechanism which rotates said plate cylinder when printing;

an image recorder for recording said images on said plate mounted on said plate cylinder;

a plate cylinder moving mechanism for moving said plate cylinder between an image recording position opposed to said image recorder and a printing position for printing with said plate mounted on said plate cylinder; and a developing device operable in said image recording position for developing said plate mounted on said plate cylinder, the developing device including:

a developing roller reciprocable between an applying position for contacting said plate to apply a developer to said plate mounted peripherally of said plate cylinder, and a retracted position spaced from said applying position, and a squeeze roller reciprocable between a squeezing position for contacting said plate to squeeze said developer applied by said developing roller off said plate mounted peripherally of said plate cylinder, and a retracted position spaced from said squeezing position, wherein said first plate cylinder rotating mechanism is operable for rotating said plate cylinder such that a period of time from said developing roller contacting said plate mounted on said plate cylinder to apply said developer thereto to said squeeze roller contacting said plate after moving from said retracted position to said squeezing position substantially corresponds to a period of time required for developing said plate with said developer, wherein said first plate cylinder rotating mechanism is operable for rotating said plate cylinder at a turning angle velocity $\theta/T$ apply after said developing roller contacts said plate to apply said developer thereto, where $\theta$ is an angle through which said plate cylinder rotates to move a position of said plate contacted by said developing roller into contact with said squeeze roller, and T is said period of time required for developing said plate with said developer.

8. A printing apparatus as defined in claim 7, wherein said developing device further includes a developing roller rotating mechanism for rotating said developing roller independently of said plate cylinder.

9. A printing apparatus as defined in claim 7, further comprising a developing device moving mechanism for moving said developing device between a developing position opposed to said plate cylinder in said image recording position, and a retracted position spaced from said developing position.

10. A printing apparatus for making a plate by recording and developing images thereon, and thereafter printing the images by feeding inks to the plate, said printing apparatus comprising:

a plate cylinder for supporting said plate mounted peripherally thereof;

a plate cylinder rotating mechanism for rotating said plate cylinder;

an image recorder for recording said images on said plate mounted on said plate cylinder; and a developing device for developing said plate mounted on said plate cylinder, wherein said developing device includes a developer feeding mechanism for feeding said developer only in time of a developing process;

a developing roller reciprocable between an applying position for contacting said plate to apply a developer to said plate mounted peripherally of said plate cylinder, and a retracted position spaced from said applying position, wherein said developer feeding mechanism includes:

a first developer tank for storing said developer;

a second developer tank for storing said developer, said second developer tank being disposed below said first developer tank;

a developer supply line for supplying said developer from said second developer tank to said first developer tank;

overflow means for maintaining said developer at a fixed level in said first developer tank;

a drain port formed in a bottom of said first developer tank;

a developer collecting line for allowing part of said developer overflowing said overflow means and part of said developer flowing out through said drain port to flow down to said second developer tank; and a pump disposed on said developer supply line for pumping said developer through said developer supply line to said first developer tank at a flow rate higher than a flow rate of said developer flowing from said drain port to said second developer tank; and a squeeze roller reciprocable between a squeezing position for contacting said plate to squeeze said developer applied by said developing roller off said plate mounted peripherally of said plate cylinder, and a retracted position spaced from said squeezing position.

11. A printing apparatus as defined in claim 10, wherein said flow rate of said developer pumped by said pump through said developer supply line to said first developer tank is lower than a maximum flow rate of said developer flowing from said drain port and said overflow means to said second developer tank.

12. A method of developing a plate for use in a printing apparatus in which a plate cylinder holding the plate at the periphery thereof is rotated by a first plate cylinder rotating mechanism and images are recorded and developed on the plate, and thereafter said plate cylinder is rotated by a second plate cylinder rotating mechanism to print the images by feeding inks to the plate, said method comprising:

a step of rotating a plate cylinder with said plate mounted peripherally thereof, by operating a first plate cylinder rotating mechanism;

an image recording step for recording said images on said plate rotating as mounted on said plate cylinder, by operating an image recorder;

a developer applying step for applying a developer to said plate rotating as mounted on said plate cylinder, by placing a developing roller in contact with said plate after said images are recorded on said plate by said image recorder; and a developer removing step for removing said developer from said plate rotating as mounted on said plate cylinder, by placing a squeeze roller in contact with said plate upon lapse of a time required for developing said plate with said developer after said developer is applied to said plate by said developing roller, wherein, at said developer applying step and said developer removing step, said plate cylinder is rotated by said first plate cylinder rotating mechanism at a turning angle velocity $\theta/T$, where $\theta$ is an angle through which said plate cylinder rotates after said developing roller contacts said plate mounted on said plate cylinder to apply said developer thereto until said squeeze roller contacts said plate, and T is a period of time required for developing said plate with said developer.

13. A method of developing a plate for use in a printing apparatus as defined in claim 12, wherein, at said developer applying step, said developing roller is rotated in a direction in which said plate cylinder is rotated by said first plate cylinder rotating mechanism, while said developing roller is maintained in contact with said plate mounted peripherally of said plate cylinder.

14. A method of developing a plate for use in a printing apparatus as defined in claim 12, further comprising a fixer applying step, executed after said developer removing step, for applying a fixer to said plate rotating as mounted on said plate cylinder, by placing a fixing roller in contact with said plate.

* * * * *